US009564006B2

(12) United States Patent
Ryan

(10) Patent No.: US 9,564,006 B2
(45) Date of Patent: Feb. 7, 2017

(54) SLOT MACHINE WITH SECONDARY GAME FEATURING REPLACEMENT SYMBOLS

(71) Applicant: Cadillac Jack, Inc., Duluth, GA (US)

(72) Inventor: Timothy Ryan, Duluth, GA (US)

(73) Assignee: Cadillac Jack, Inc., Duluth, GA (US)

( * ) Notice: Subject to any disclaimer, the term of this patent is extended or adjusted under 35 U.S.C. 154(b) by 140 days.

(21) Appl. No.: 13/754,554

(22) Filed: Jan. 30, 2013

(65) Prior Publication Data

US 2014/0162751 A1 Jun. 12, 2014

Related U.S. Application Data

(63) Continuation of application No. 13/712,920, filed on Dec. 12, 2012, now Pat. No. 9,011,233.

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3244* (2013.01); *G07F 17/32* (2013.01); *G07F 17/326* (2013.01); *G07F 17/3213* (2013.01); *G07F 17/3267* (2013.01); *G07F 17/34* (2013.01)

(58) Field of Classification Search

CPC ..... G07F 17/32; G07F 17/3213

See application file for complete search history.

(56) References Cited

U.S. PATENT DOCUMENTS

| | | | | |
|---|---|---|---|---|
| 6,120,378 | A * | 9/2000 | Moody et al. | 463/20 |
| 6,375,570 | B1 * | 4/2002 | Poole | 463/31 |
| 6,896,617 | B2 * | 5/2005 | Daly | 463/20 |
| 2004/0097280 | A1 * | 5/2004 | Gauselmann | 463/16 |
| 2004/0180714 | A1 * | 9/2004 | Ward | 463/20 |
| 2005/0148384 | A1 * | 7/2005 | Marks et al. | 463/20 |
| 2008/0051184 | A1 * | 2/2008 | Okada | 463/20 |
| 2010/0048287 | A1 * | 2/2010 | Yoshizawa | G07F 17/3267 463/20 |
| 2012/0108317 | A1 * | 5/2012 | Caputo et al. | 463/20 |
| 2013/0190065 | A1 * | 7/2013 | Saunders | 463/20 |

* cited by examiner

*Primary Examiner* — Lawrence Galka
(74) *Attorney, Agent, or Firm* — Weide & Miller, Ltd.

(57) ABSTRACT

Examples disclosed herein relate to systems and methods, which may receive wagers on one or more paylines. The systems and methods may utilize one or more symbol positions which may provide additional gaming functionality. The systems and methods may determine one or more payouts based on the additional gaming functionality. The systems and methods may display one or more presentations based on the additional gaming functionality.

17 Claims, 21 Drawing Sheets

SLOT MACHINE WITH SECONDARY GAME FEATURING REPLACEMENT SYMBOLS

CROSS-REFERENCE TO RELATED PATENT APPLICATION

This application is a continuation of prior application Ser. No. 13/712,920 entitled "ELECTRONIC GAMING SYSTEM WITH ADDITIONAL GAMING FUNCTIONALITY", filed on Dec. 12, 2012, which is incorporated herein by reference in its entirety.

FIELD

The subject matter disclosed herein relates to an electronic gaming system and method of implementing a wagering game on an electronic gaming system. More specifically, the disclosure relates to an electronic gaming system and methods that provides a subset of gaming symbol positions that include additional gaming functionality.

Information

The gaming industry has numerous casinos located both worldwide and in the United States, and both land-based and online. A client of a casino or other gaming entity can gamble via various games of chance. For example, craps, roulette, baccarat, blackjack, and electronic or electromechanical games (e.g., a slot machine, a video poker machine, and the like) where a person may gamble on an outcome.

Historically, the success of electronic gaming systems is dependent on several elements, which may not be readily apparent. Success can depend upon the prospect of winning money from the gaming system, whether such prospect is real or perceived which can carry an intrinsic entertainment value as compared to other gaming system offerings. Additionally, the success can also depend upon the ease by which a new player can understand the game mechanics, as it is unlikely that a new player will expend money wagering on a gaming system if they do not understand the game mechanics. Players can become frustrated when an outcome is a non-winning outcome that the player believes should be a winning outcome. A player's enjoyment and interest in a game may be increased by employing an electronic gaming system and methods that provides a subset of gaming symbol position that include additional gaming functionality.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
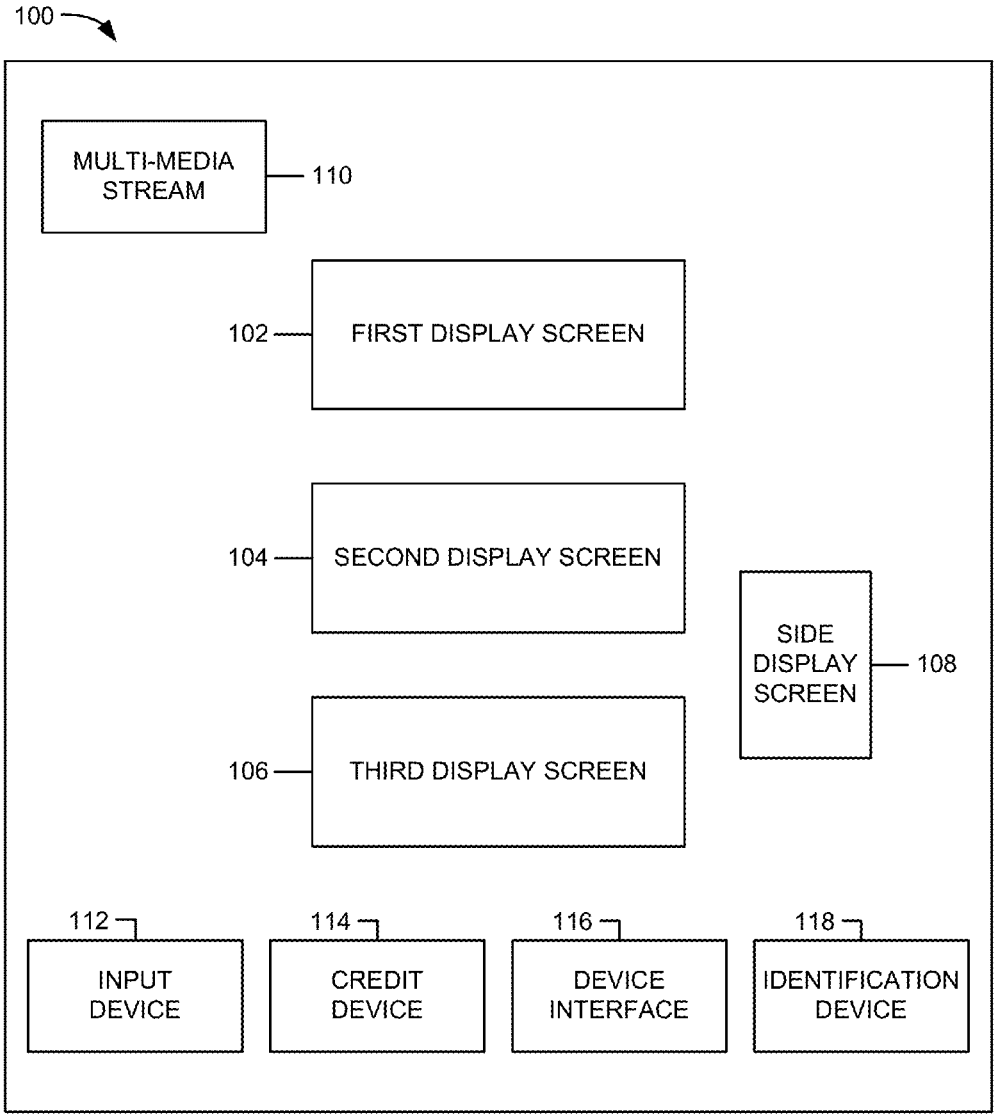
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to control any object (e.g., a tool, a person, an image, a selection option, etc.), to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, an embedded gaming functionality may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have game play which has only embedded gaming based functionality (or similar functionality). Therefore, no games without embedded gaming functionality would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

The presentations associated with embedded gaming based game may be presented on one, a few, and/or a plurality of screens. These presentations associated with embedded gaming based game play may be displayed on a portion of one, a few, and/or a plurality of these screens.

For example, a single large image could be partially displayed on second display screen 104 and partially displayed on third display screen 106, so that when both display screens are put together they complete one image. Electronic gaming device 100 may stream or play prerecorded multimedia data, which may be displayed on any display combination.

Figure 2:
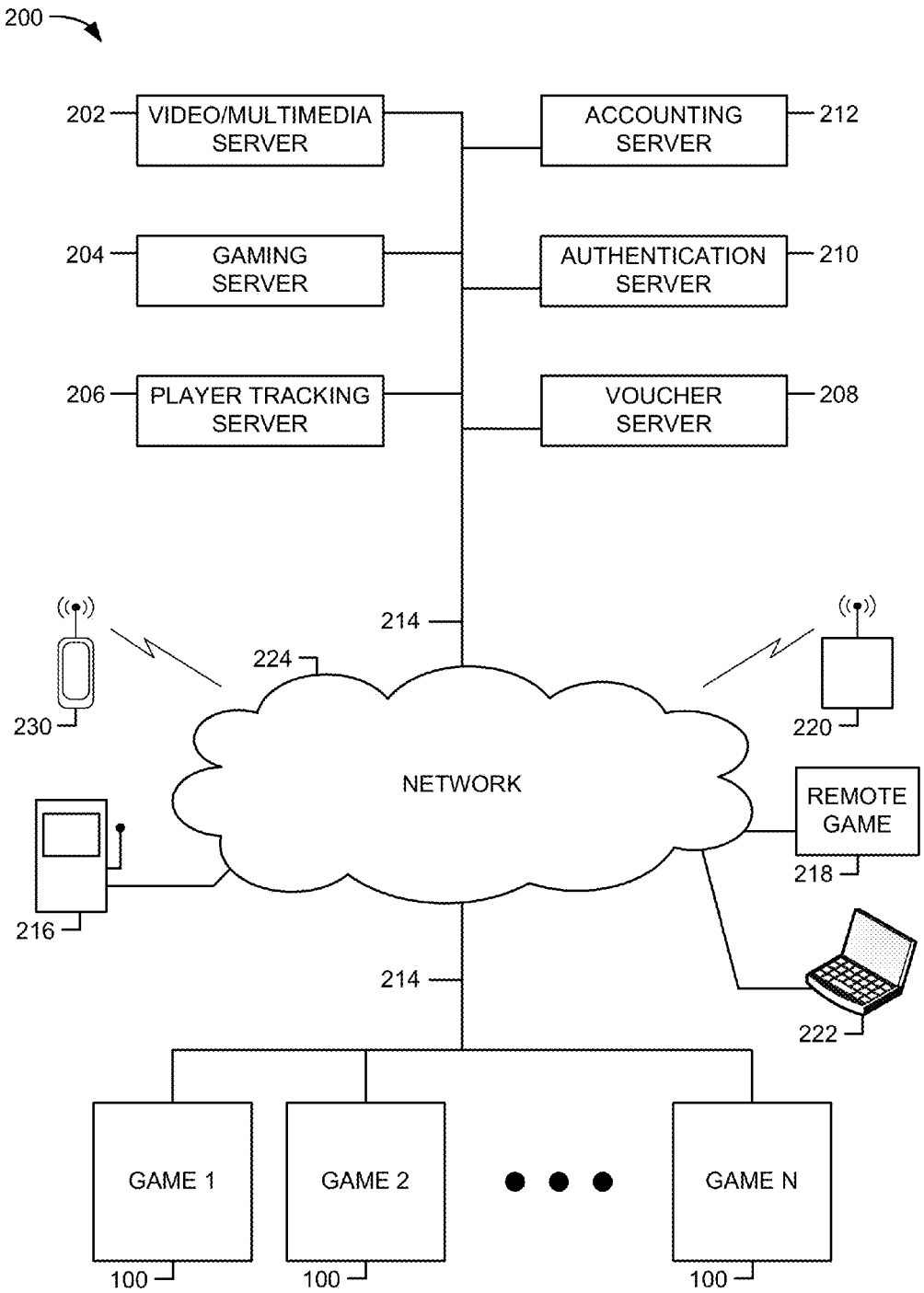
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a payout functionality, an embedded gaming play functionality, an embedded gaming play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include embedded gaming based game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Statistics server may include data relating to one or more embedded gaming based game play (or similar game play). This data may include the number of times a specific item (e.g., a rose, a star, etc.) was selected. The frequency of any specific item being selected and the amount won. This data may also include data relating to any interrelationship of elements. For example, when the star is selected, the player selects a rose on 75% of the time. Further, this selection pairing results in a winning result 55% of the time.

Figure 3:
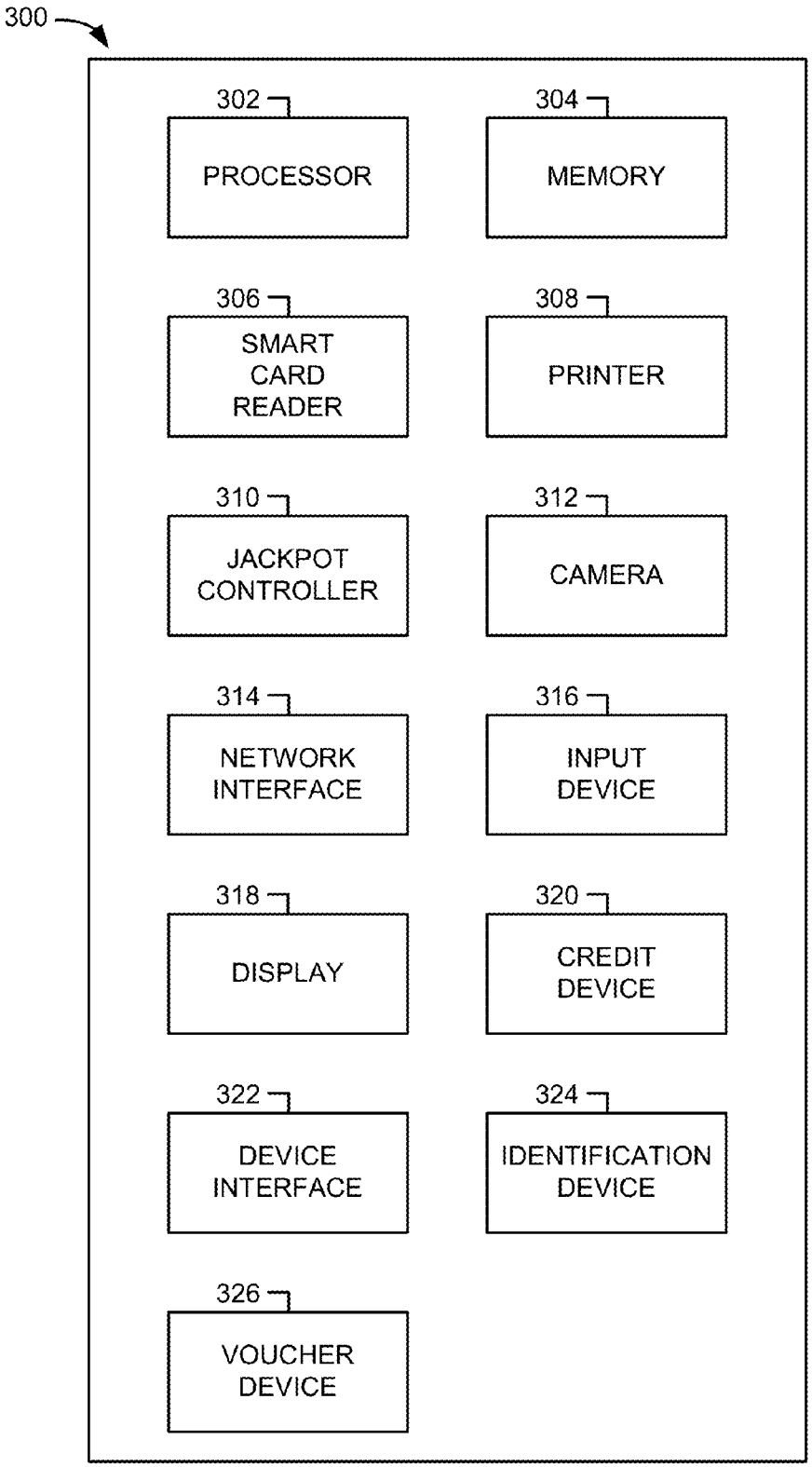
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to select one or more embedded gaming based gaming options, to make an offer to buy or sell a voucher, to determine a voucher's worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
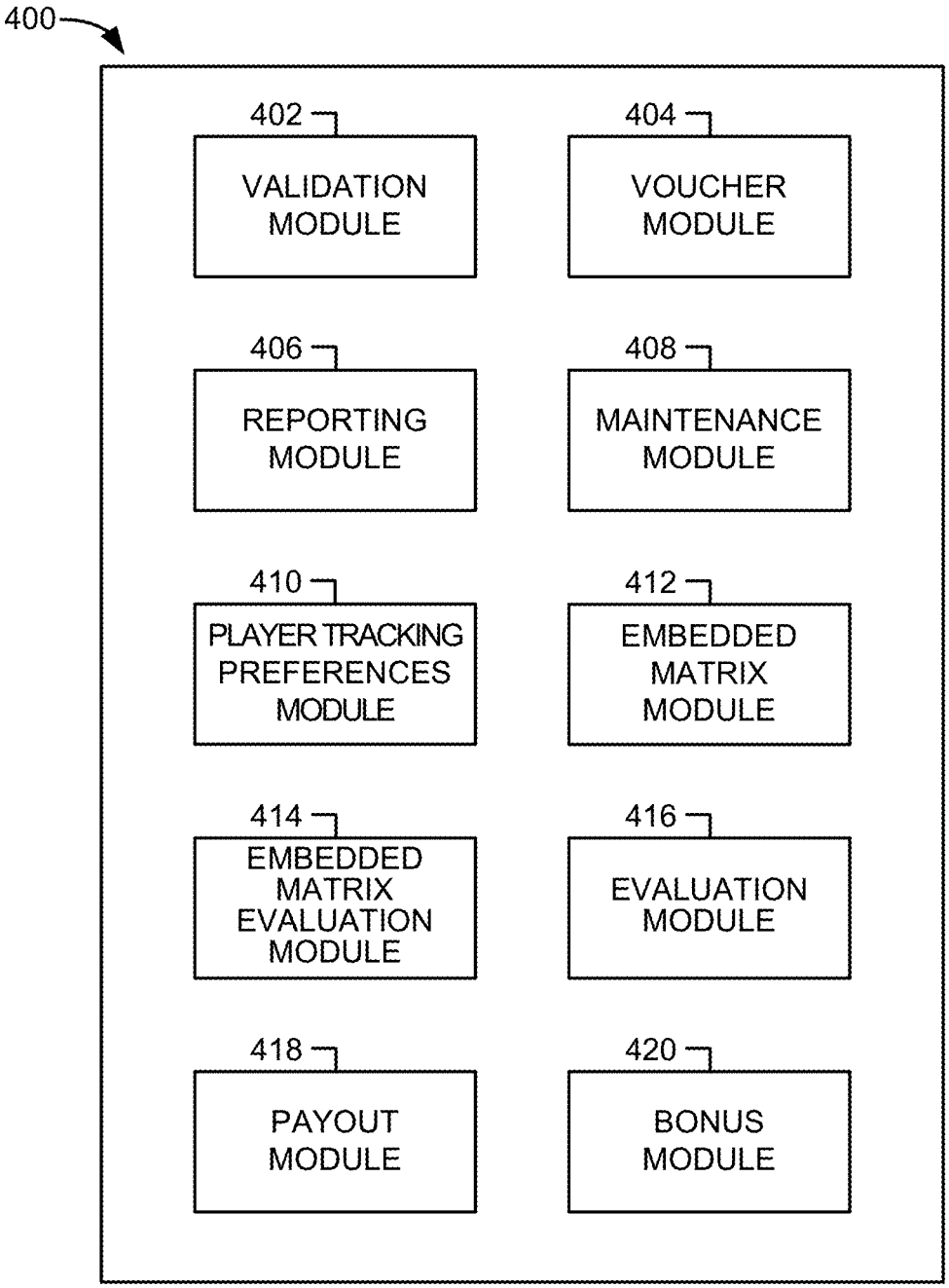
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an embedded matrix module 412, an embedded matrix evaluation module 414, an evaluation module 416, a payout module 418, and/or a bonus module 420.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Embedded matrix module 412 may generate, compile, transmit, and/or store one or more embedded matrix structures. Embedded matrix module 412 may compile data (e.g., utilization rate, win rate, etc.) relating to one or more embedded matrix structures.

Embedded matrix evaluation module 414 may evaluate one or more outcomes for one or more events which may be based on one or more outcomes for one or more embedded gaming based game play.

Evaluation module 416 may evaluate one or more outcomes for one or more events which may not be based on one or more outcomes for one or more embedded gaming based game play. Evaluation module 416 may evaluate one or more outcomes for one or more events which may be based on one or more outcomes for one or more embedded gaming based game play.

Payout module 418 may determine one or more payouts which may relate to one or more inputs received from the player, electronic gaming device 100, and/or electronic gaming system 200. Payout module 418 may determine one or more payouts based on one or more selections.

Bonus module 420 may generate a bonus game, evaluate the results of the bonus game, trigger bonus game presentations, generate bonus game payouts, and/or display any data relating to the bonus game.

A presentation generation module may generate the presentation data (e.g., visual and audio) relating to one or more game play options. A presentation module may display one or more of the generated presentations.

It should be noted that one or more modules may be combined into one module. Further, there may be one evaluation module where the determined payout does not depend on whether there were any wild symbols, scatter symbols, embedded gaming based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
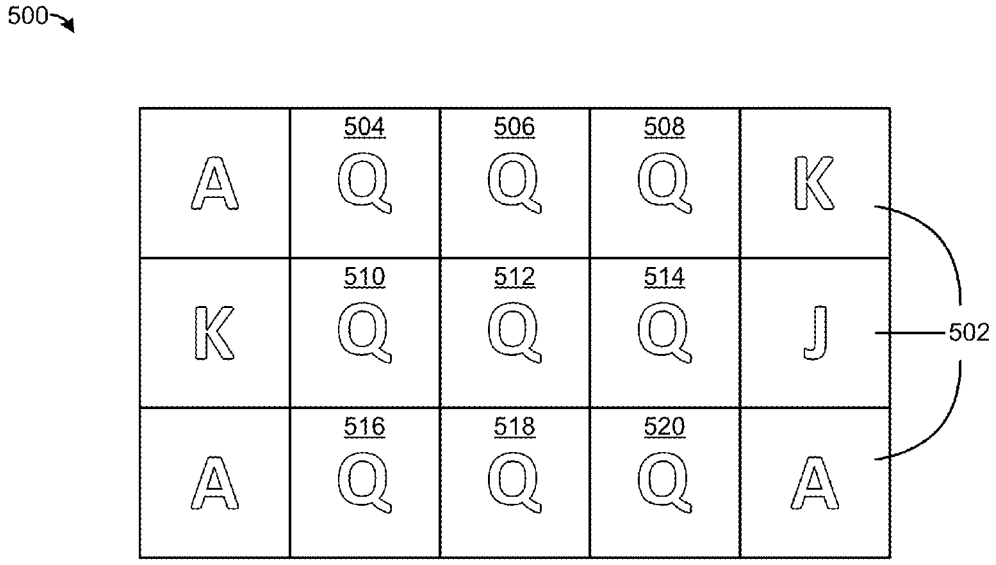
FIG. 5A is an illustration of a display device output on an exemplary gaming system, according to one embodiment.
Figure 5B:
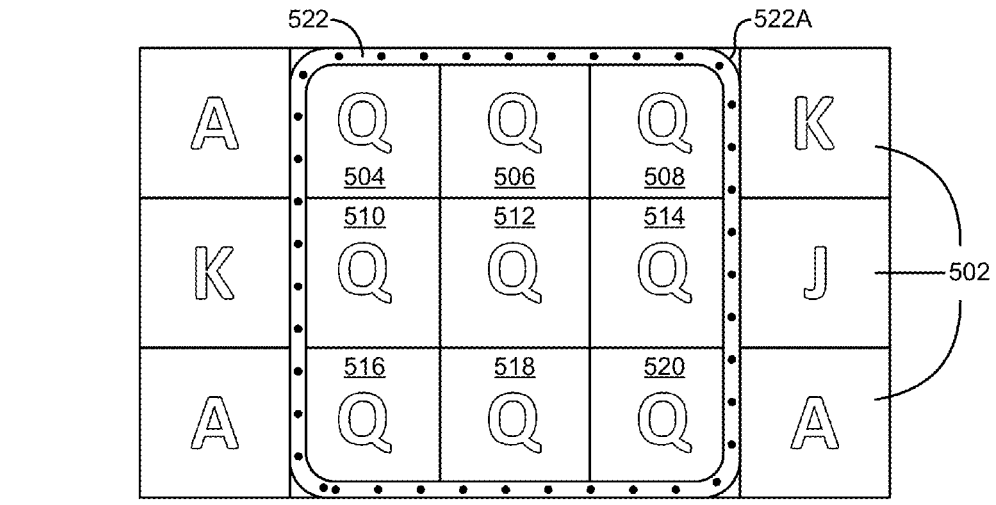
FIG. 5B is another illustration of a display device output on an exemplary gaming system, according to one embodiment.
Figure 5C:
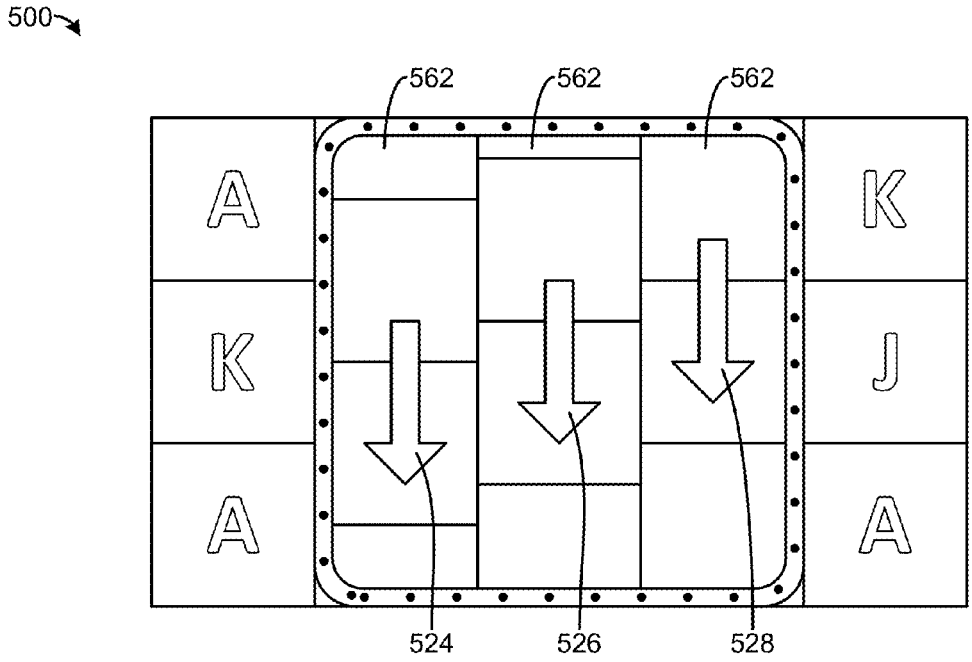
FIG. 5C is another illustration of a display device output on an exemplary gaming system, according to one embodiment.
Figure 5D:
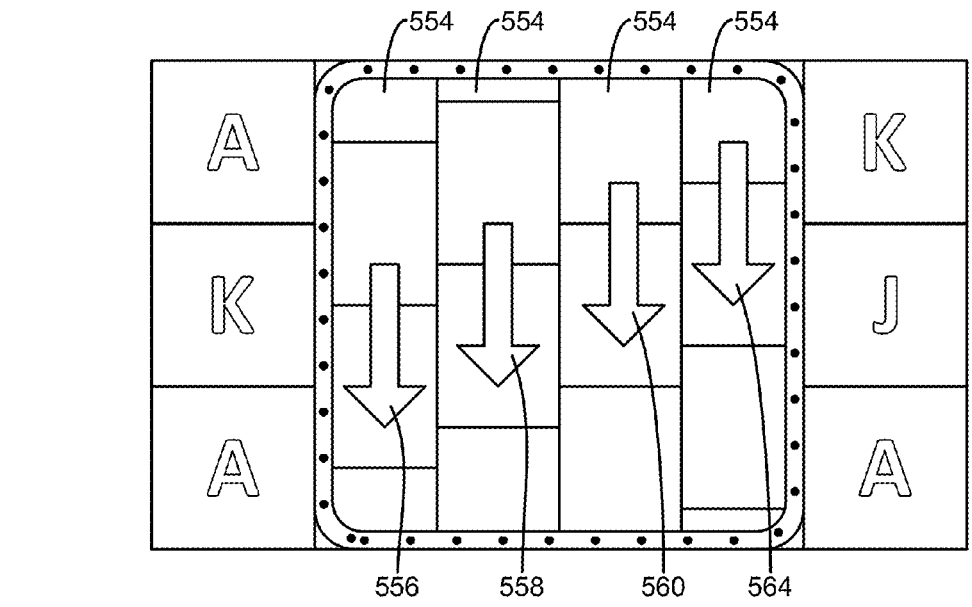
FIG. 5D is another illustration of a display device output on an exemplary gaming system, according to one embodiment.
Figure 5E:
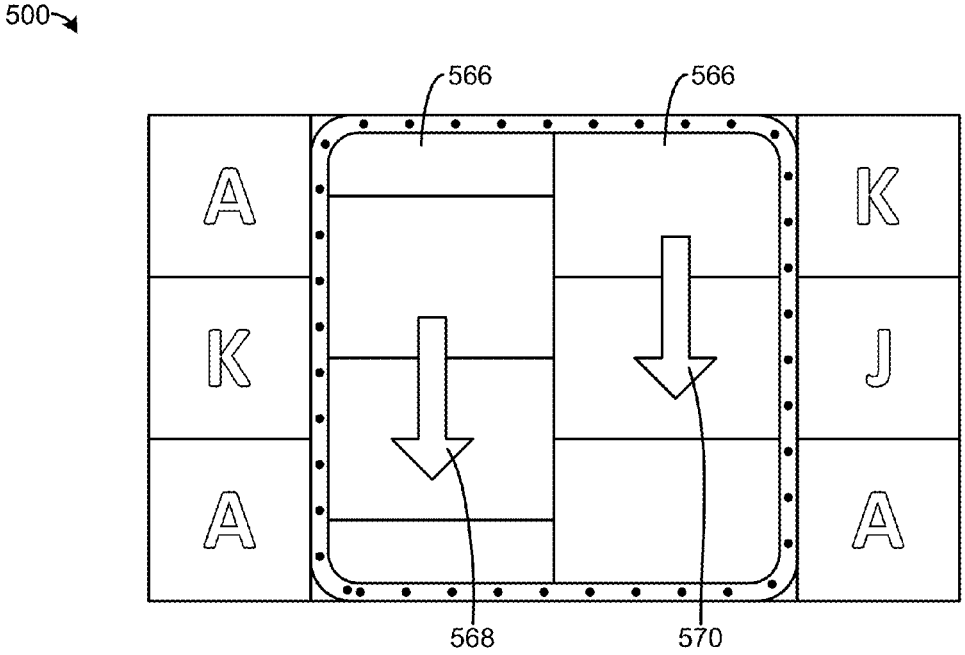
FIG. 5E is another illustration of a display device output on an exemplary gaming system, according to one embodiment.
Figure 5F:
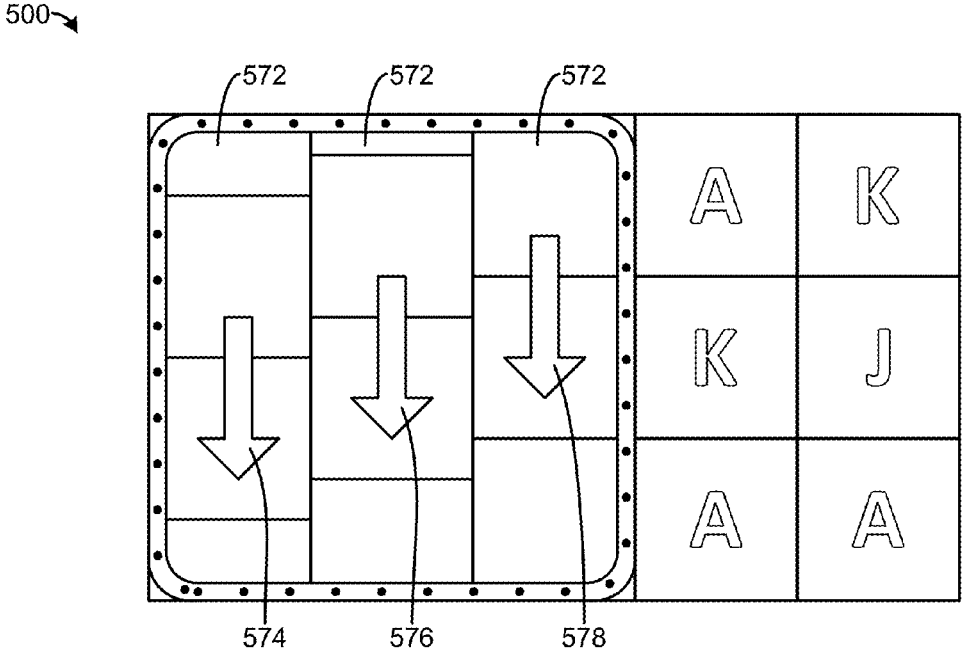
FIG. 5F is another illustration of a display device output on an exemplary gaming system, according to one embodiment.
Figure 5G:
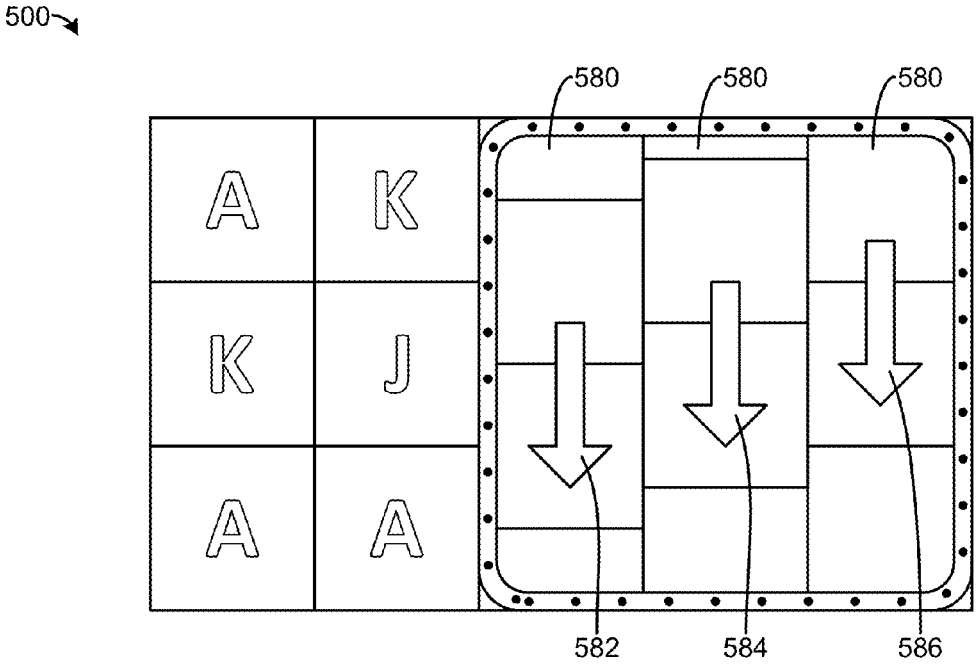
FIG. 5G is another illustration of a display device output on an exemplary gaming system, according to one embodiment.
Figure 5H:
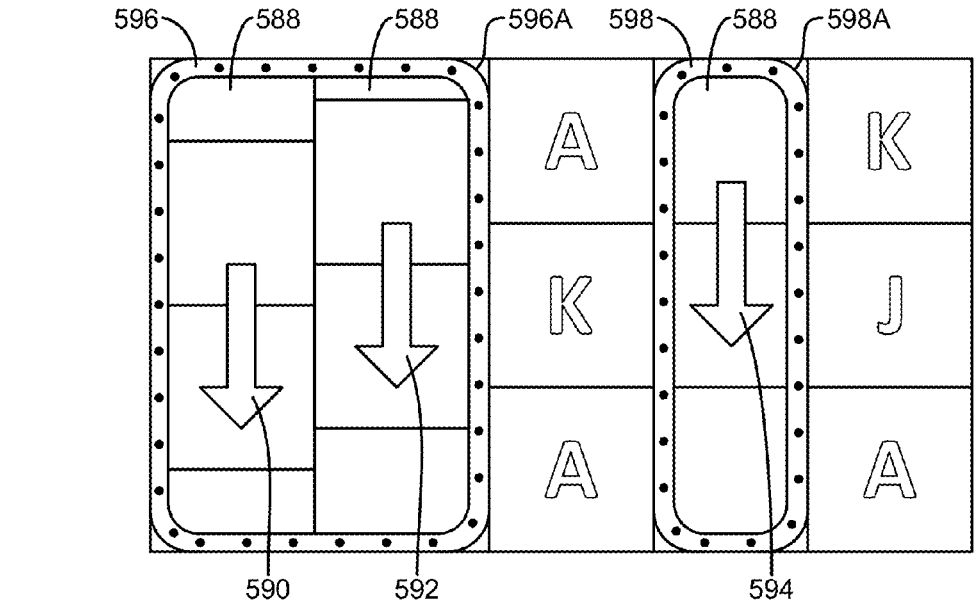
FIG. 5H is another illustration of a display device output on an exemplary gaming system, according to one embodiment.
Figure 5J:
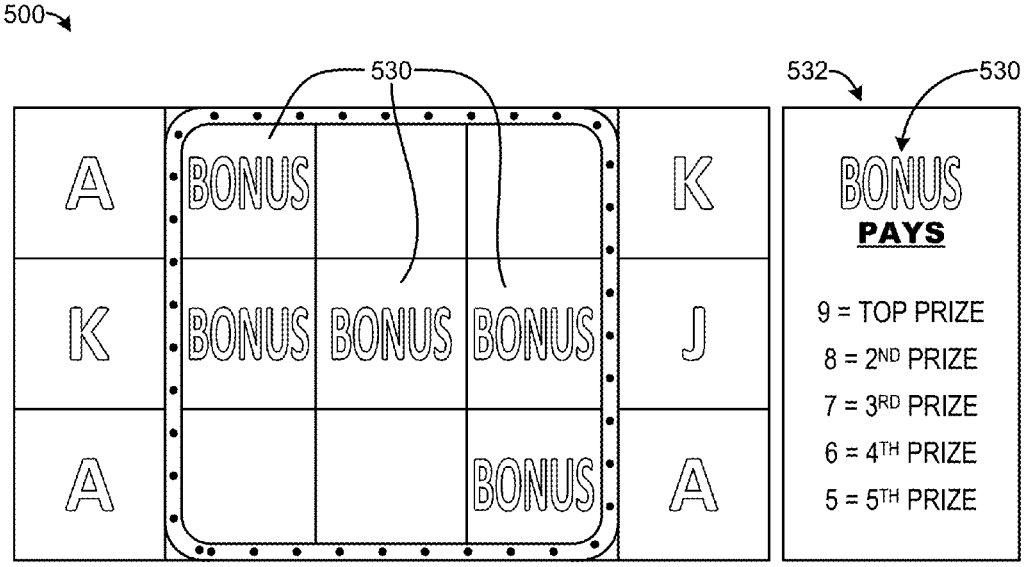
FIG. 5J is another illustration of a display device output on an exemplary gaming system, according to one embodiment.
Figure 5K:
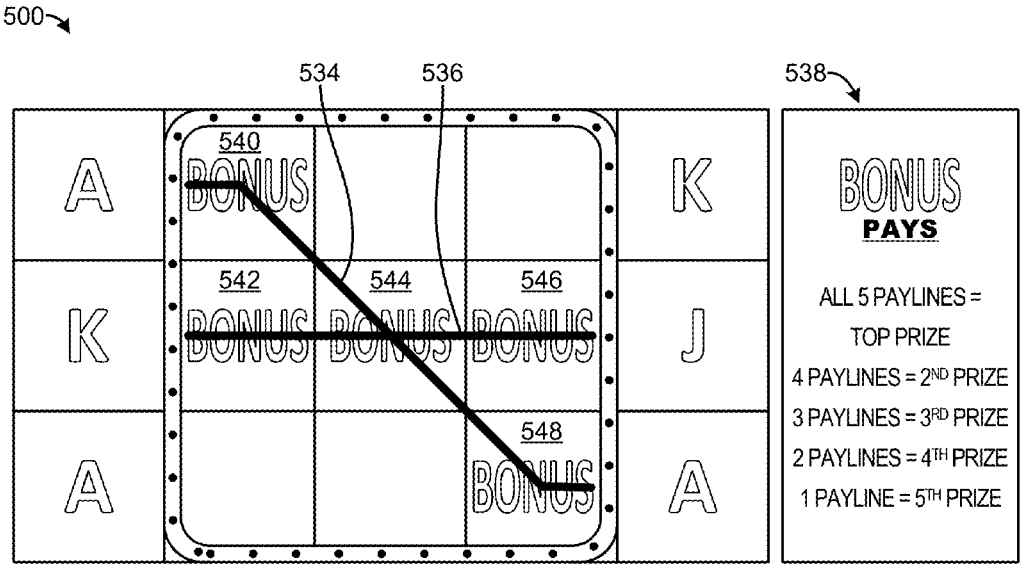
FIG. 5K is another illustration of a display device output on an exemplary gaming system, according to one embodiment.
Figure 5L:
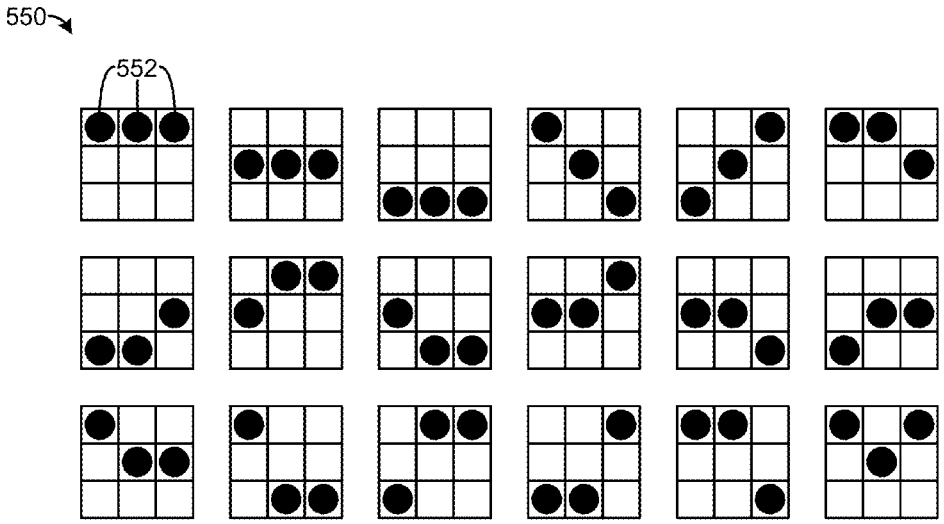
FIG. 5L is an illustration of one or more secondary game payline configurations, according to one embodiment.
Figure 5M:
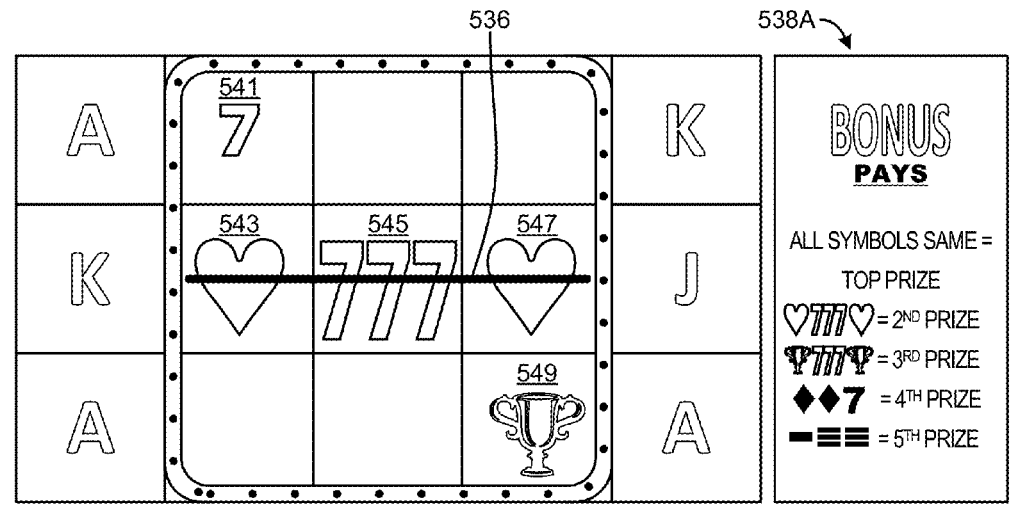
FIG. 5M is another illustration of a display device output on an exemplary gaming system, according to one embodiment.
Figure 5N:
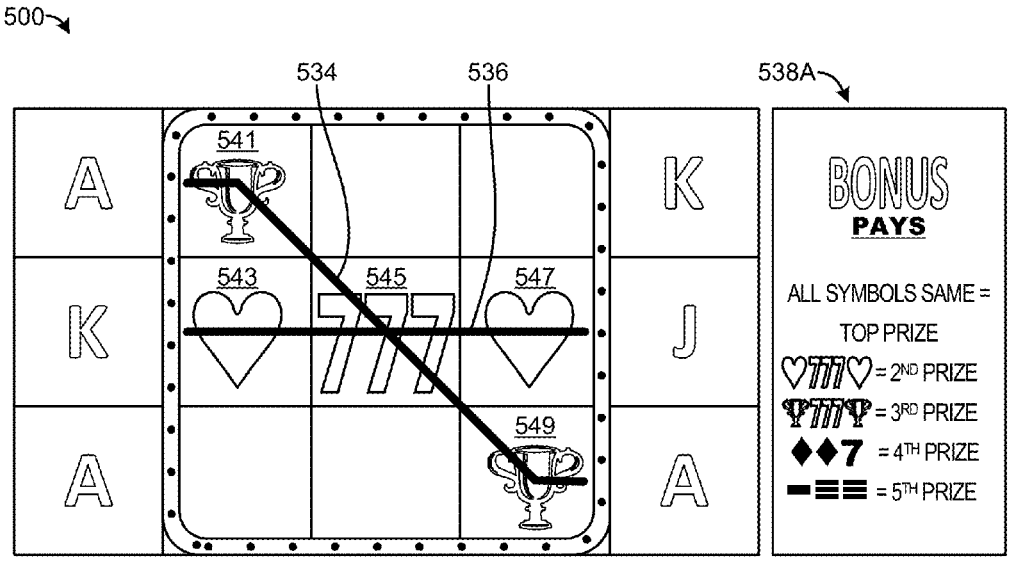
FIG. 5N is another illustration of a display device output on an exemplary gaming system, according to one embodiment.

FIGS. 5A-5N are various interaction illustrations for a subset of symbol positions having additional gaming functionality, according to various embodiments.

In FIG. 5A, a first display image 500 may include a matrix 502. Matrix 502 may include a plurality of reels, a plurality of areas, a plurality of rows, a plurality of columns, and/or any combination thereof. In this illustration, matrix 502 may be further configured in an orthogonal fashion, with vertical columns and horizontal rows. In one embodiment, matrix 502 may be partially or wholly non-orthogonal.

FIG. 5A further illustrates a plurality of primary game symbols (e.g. "A", "K", "Q", "J") being displayed at a plurality of symbol positions. In this example, there are fifteen symbol positions in the illustrated 3×5 matrix 502. In one embodiment, a single column from matrix 502 may display primary game symbols from a single reel, which may be referred to as a dependent reel because a symbol displayed in one reel position may have a relationship or dependency on a vertically-adjacent symbol being displayed. In another embodiment, each symbol position may have a distinct reel associated with it, which may be referred to as an independent reel, because a symbol may be displayed at one symbol position which may be independent of a symbol caused to be displayed at an immediately adjacent symbol position. In still another embodiment, the primary game symbols are caused to drop into position, which may be illustrated as the primary game symbols falling into place, and are referred to as cascading reels.

Proceeding with this example, matrix 502 may include a predetermined subset of symbol positions (e.g., symbols 504-520), which may have added gaming functionality. Matrix 502 may include a predetermined area 522A where the predetermined subset of symbol positions may be located (see FIG. 5B). In one embodiment, the locations of the predetermined subset of symbol positions which may have added gaming functionality may be provided to a player of the gaming system prior to play of the primary game. In another embodiment, the locations of the predetermined subset of symbol positions having added functionality may not be made apparent to a player of the gaming system prior to play of the primary game. In the present illustration, the predetermined subset of symbol positions having added functionality 504-520 may include both vertically adjacent symbol positions and horizontally adjacent symbol positions.

In a further embodiment, there may be a single grouping of the predetermined subset of symbol positions having added functionality (see FIGS. 5B-5E). In a different embodiment, there may be multiple groupings of the predetermined subset of symbols having added functionality (see FIGS. 5E-5H). In one example of this embodiment, the specific extra functionality provided may be dependent upon which of the multiple groupings of the predetermined subset of symbol positions satisfied a triggering condition. For example, a first predetermined subset of symbol positions (e.g., FIG. 5F) may trigger a symbol accumulation bonus sequence, as generally shown in FIG. 5J, while a second predetermined subset of symbol positions (e.g. FIG. 5G) may trigger a bonus payline evaluation sequence, as generally shown in FIG. 5K. In another possible example, a first predetermined subset of symbol positions (e.g., FIG. 5H) may trigger added gaming functionality which may utilize secondary reels, similar to FIGS. 5J-5N, while a second predetermined subset of symbol positions (e.g., FIG. 6A) may trigger a secondary selection game, similar to FIGS. 6C-6J.

In another example of this embodiment, the same extra functionality may be provided regardless as to which of the multiple groupings of the predetermined subset of symbols satisfied a triggering condition. In one such possible example, a first predetermined subset of symbol positions (e.g., FIG. 5C) may trigger a secondary reel game as shown in FIG. 5K while a second predetermined subset of symbol positions (e.g., FIG. 5F) may also trigger a secondary reel game as shown in FIG. 5K.

In another example of this embodiment, if two or more separate groupings of the predetermined subset of symbols satisfy a triggering condition, electronic gaming device 100 and/or electric gaming system 200 may determine a single specific extra functionality to provide. In one possible example of this embodiment, a first predetermined subset of symbol positions (e.g., FIG. 5G) may trigger additional gaming functionality which may, on average, return 100 credits to a player, while a second predetermined subset of symbol positions (e.g., FIG. 5C) may trigger additional gaming functionality which may, on average, return 75 credits to a player, and if both the first and second subset of symbol positions satisfy the triggering condition, the gaming system may automatically select the added gaming functionality that will, on average, provide the highest return to the player. In another example, the gaming system may automatically select the added gaming functionality that will, on average, provide the lowest return to the player. In a further example, the gaming system may select the added gaming functionality to provide based on a random determination, a predetermined basis, a prior play of the gaming system, a play of a separate gaming system, the identity of the player, a combination of payouts (e.g., 100 credits plus 75 credits=175 credits payout), and/or any combination thereof.

In a further example of this embodiment, if two or more separate groupings of the predetermined subset of symbols satisfy a triggering condition, each of the specific extra functionality associated with the respective groupings may be provided. In one example, a first predetermined subset of symbol positions (e.g. FIG. 5C) may trigger a symbol accumulation bonus sequence, as generally shown in FIG. 5J, while a second predetermined subset of symbol positions (e.g., FIG. 5F) may trigger a bonus payline evaluation sequence, as generally shown in FIG. 5K, and the gaming system may provide each sequence in series to a player. In another example, the gaming system may provide each sequence in parallel, so that the player may be able to view both sequences simultaneously. In a further example, the gaming system may cause first display image 500 to be replicated on a separate display device, and each display device may display a separate bonus sequence.

Continuing with FIG. 5A, each of the predetermined subset of symbol positions having added functionality 504-520 may be displaying a matching "Q" symbol, which in the present example causes the predetermined subset of symbol positions having added functionality 504-520 to trigger the added functionality, as discussed more fully below. In one embodiment, matching symbols may be identical-looking symbols. In one example of this embodiment, the matching symbols may each have the same shape, color, size, and/or basic layout. In another example of this embodiment, the matching symbols may have subtle differences, but to a casual or non-trained viewer, may appear to be identical.

In another embodiment, matching symbols may be similar-looking symbols. In one example of this embodiment, some or each of the matching symbols may be representations of the same general item (e.g., a castle), but may be drawn from different perspectives or may utilize different color schemes. In another example, matching symbols may be different examples of items which could be properly grouped into a single category. For example, matching symbols may include generally all symbols that represent a butterfly, regardless of what type of butterfly that may be represented by any specific symbol.

In still another embodiment, matching symbols may be symbols that have a visual association with each other. One possible example of this embodiment may include a "lock" symbol and a "key" symbol, which may be different looking symbols but have a visual association with each other. Another possible example may be symbols which represent different pieces of a puzzle. Another possible example may be a series of symbols which together may form a timeline and/or story.

In still another example, matching symbols may be symbols that have a similar paytable valuation associated with them so that a like number of either symbol causes the same award to be provided. In such an example, first matching symbols may include a "bell" symbol, which by itself may have an award of 5 times the line wager if five of them occur on a payline, and second matching symbols may include a "fruit" which may also have an award of 5 times the line wager if five of them occur on a payline. In this example, the display of "bell" and "fruit" symbols may be evaluated as the same matching symbol.

In still a further example, matching symbols may have a numeric relationship to each other. In one such possible example, matching symbols may be consecutive numbers. In another such possible example, matching symbols may have a mathematical relationship, such that a first matching symbol plus a second matching symbol equals a third matching symbol.

In one embodiment, the reels displaying the primary game symbols in FIG. 5A may be independent reels. In another embodiment, the reels displaying the primary game symbols in FIG. 5A may be dependent reels. In this embodiment, the grouping of matching symbols on a single vertical reel may be called "stacked symbols" and may be beneficial to incorporate into a game as their presence can build excitement as they appear as a block of symbols as they spin by. It is contemplated though, whether the reels are dependent, independent, and/or cascading, that the primary game outcome being displayed by FIG. 5A may historically be viewed negatively by a player due to the high number of matching symbols being displayed, but by a typical left-to-right evaluation that may be performed in gaming machines, a win does not exist as none of the primary game symbols displayed in the first column match the "Q" symbol displayed. It is specifically contemplated that in certain embodiments, the utilization of matching symbols occurring in both vertical and horizontal adjacency to trigger the additional gaming functionality of their associated symbol positions may be particularly advantageous in that it can turn a historically negative outcome into a positive outcome, or, in the case where there may be at least one matching symbol in the first column which would historically mean a large win (based on the number of paylines traversing the four columns of matching symbols), and which would add further excitement to an already exciting win.

In one embodiment, an oversized symbol may be displayed, that may be large enough to take the traditional symbol position of a plurality of traditional symbols. In an example, one reel may display only an oversized matching symbol while another reel may display a plurality of smaller sized matching symbols. In another embodiment, the primary game symbols being displayed may be the symbols first displayed when their associated reels stopped spinning. In another embodiment, at least one of the primary game symbols was transformed after its associated reel stopped spinning. In one illustrative example, two symbol positions (e.g., 510 and 516) may not initially display a "Q" but the "Q" displayed at symbol position 504 may be an expanding symbol, and after the symbols came to stop, expanded to replace the originally-displayed symbols at 510 and 516 with a "Q." In another illustrative example, two symbol positions (e.g., 518 and 520) initially did not display a "Q" but the "Q" displayed at symbol position 512 may be a reactive symbol, and first reacted with the particular symbol displayed at symbol position 518 to convert it to a "Q" and then the newly converted "Q" at symbol position 518 further reacted with the original primary game symbol displayed at symbol position 520 to convert it to a "Q." In various examples, there may be numerous ways to convert a first-displayed primary game symbol into a different primary game symbol, and it is contemplated that the existence or non-existence of such symbol conversion does not remove a particular embodiment from the present disclosure.

In FIG. 5B, matrix 502 may be supplemented with an event notification 522, to inform the player that added functionality has been triggered. In this example, event notification 522 appears as a lighted border around the predetermined subset of symbol positions (e.g., 504-520) having added functionality that may be displaying the matching symbols, which further acts to reinforce and communicate the necessary trigger, in this embodiment, for the added functionality—that each of the predetermined subset of symbol positions (e.g., 504-520) display a matching symbol (or other symbol relationship and/or symbol interactions). Utilizing event notification 522 can be particularly advantageous, as it serves to both inform the player about the necessary trigger, and due to the larger size of the trigger itself, the necessarily large size of event notification 522 may create an easily noticed event for surrounding players, which can create an even larger sense of excitement as the surrounding players all gather around to view the extra gaming functionality.

FIG. 5C illustrates first display image 500 displaying the predetermined subset of symbol positions triggering added functionality. In this example, the predetermined subset of symbol positions 504-520 may be replaced by secondary game reels 562 which are shown in FIG. 5C as already spinning, as illustrated by arrows (e.g., 524-528). In one embodiment, secondary game reels 562 may include at least one secondary game symbol that may be different than any of the plurality of primary game symbols. In one example, one or more special bonus symbols may be associated with the secondary game reels 562, but may not be part of the grouping of primary game symbols. In another embodiment, each secondary game symbol may be different than each of the primary game symbols. In a further embodiment, secondary game symbols may be similar to and/or identical to the primary game symbols, but the reel strip may be laid out and/or "weighted" differently so that at least one secondary game symbol has a different probability of being displayed as compared to its similar and/or identical primary game symbol. In one example, a first primary game symbol may have a 5% probability of being displayed on the 3rd primary game reel in any single spin, but as a secondary game symbol, it may have a 15% probability of being displayed on the 3rd secondary game reel in any single spin. While secondary game reels 562 are displayed as dependent reels, it is contemplated that they may be independent reels, cascading reels, and/or any combination thereof FIG. 5D illustrates first display image 500 displaying the predetermined subset of symbol positions triggering added functionality. In this example, the predetermined subset of symbol positions 504-520 may be replaced by secondary game reels 554 which are shown in FIG. 5D as already spinning, as illustrated by arrows (e.g., 556-564). In this example, the predetermined subset of symbol positions 504-520 may be replaced by a greater number of secondary game reels 554. In one example, this may allow for a greater number of award determinations, because more secondary game symbols may be displayed, which may cause more excitement for a player. In one embodiment, secondary game reels 554 may include at least one secondary game symbol that may be different than any of the plurality of primary game symbols. In another embodiment, each secondary game symbol may be different than each of the primary game symbols. In a further embodiment, secondary game symbols may be similar to or identical to the primary game symbols, but the reel strip may be laid out or "weighted" differently so that at least one secondary game symbol has a different probability of being displayed as compared to its similar or identical primary game symbol. While secondary game reels 554 are displayed as dependent reels, it is contemplated that they may be independent reels, cascading reels, and/or any combination thereof.

FIG. 5E illustrates first display image 500 displaying the predetermined subset of symbol positions triggering added functionality. In this example, the predetermined subset of symbol positions 504-520 may be replaced by secondary game reels 566 which are shown in FIG. 5E as already spinning, as illustrated by arrows (e.g., 568 and 570). In this example, the predetermined subset of symbol positions 504-520 may be replaced by a fewer number of secondary game reels 566. In one example, this may allow for a fewer number of award determinations, because fewer secondary game symbols may be displayed, which may be more easily understood by a player. In one example, secondary game symbols displayed on secondary game reels 566 are larger than the primary game symbols that are being replaced, which may cause more excitement for players. In one embodiment, secondary game reels 566 may include at least one secondary game symbol that may be different than any of the plurality of primary game symbols. In another embodiment, each secondary game symbol may be different than each of the primary game symbols. In a further embodiment, secondary game symbols may be similar to or identical to the primary game symbols, but the reel strip may be laid out or "weighted" differently so that at least one secondary game symbol has a different probability of being displayed as compared to its similar or identical primary game symbol. While secondary game reels 566 are displayed as dependent reels, it is contemplated that they may be independent reels, cascading reels, and/or any combination thereof.

FIG. 5F illustrates first display image 500 displaying a different predetermined subset of symbol positions triggering added functionality. In one example, the predetermined subset of symbol positions located on the first three reels may be replaced by secondary game reels 572, which are shown in FIG. 5F as already spinning, as illustrated by arrows (e.g., 574-578). In one embodiment, the symbol positions illustrated in FIG. 5F may provide a first added gaming functionality, while a different grouping of symbol positions (e.g. FIG. 5G) may provide a second added gaming functionality. In another embodiment, the symbol positions illustrated in FIG. 5F may provide a first added gaming functionality, while a different grouping of symbol positions (e.g. FIG. 5C) may provide the same first added gaming functionality. In another embodiment, the symbol positions illustrated in FIG. 5F may be the only symbol positions which provide added gaming functionality.

FIG. 5G illustrates first display image 500 displaying a different predetermined subset of symbol positions triggering added functionality. In one example, the predetermined subset of symbol positions located on the last three reels may be replaced by secondary game reels 580, which are shown in FIG. 5G as already spinning, as illustrated by arrows (e.g., 582-586). In one embodiment, the symbol positions illustrated in FIG. 5G may provide a first added gaming functionality, while a different grouping of symbol positions (e.g. FIG. 5F) may provide a second added gaming functionality. In another embodiment, the symbol positions illustrated in FIG. 5G may provide a first added gaming functionality, while a different grouping of symbol positions (e.g. FIG. 5C) may provide the same first added gaming functionality. In another embodiment, the symbol positions illustrated in FIG. 5G may be the only symbol positions which provide added gaming functionality.

In one example, the location of the predetermined subset of symbol positions triggering the added functionality may influence the expected award from the bonus game. For example, the trigger generally illustrated in FIG. 5F may be associated with a higher expected return for the player than the trigger generally illustrated in FIG. 5G. In another example, any expected award from the bonus game may be independent from which the predetermined subset of symbol positions was associated with the bonus trigger.

FIG. 5H illustrates first display image 500 displaying a different predetermined subset of symbol positions triggering added functionality. In one example, the predetermined subset of symbol positions located on the first two reels and the fourth reel may be replaced by secondary game reels 588, which are shown in FIG. 5H as already spinning, as illustrated by arrows (e.g., 590-594). In one example, first display image 500 may include one or more event notifications 596 and 598 to inform the player that added functionality has been triggered. In this example, event notification 596 and 598 may appear as a lighted border around the predetermined subset of symbol positions 596A and 598A having added functionality that may be displaying the matching symbols, which further acts to reinforce and communicate the necessary trigger, in this embodiment, for the added functionality.

In one embodiment, non-adjacent secondary game reels may still be evaluated as adjacent secondary game reels. For example, secondary game reels 588, once they have stopped and may display secondary game symbols, may be evaluated as a three reel secondary game. In another embodiment, adjacent secondary game reels are evaluated in a different manner than a non-adjacent secondary game reel. For example, the first two secondary game reels 588 may be utilized to determine an initial prize value, while the third secondary game reel 588 may be utilized to modify any determined award (e.g., a multiplier). In one embodiment, at least two of the columns of the predetermined subset of symbol positions (e.g., 596A) may be adjacent. In another embodiment, each of the columns of the predetermined subset of symbol positions may not be adjacent to another one.

As discussed previously, in one example, different predetermined subset of symbol positions, as generally illustrated in FIGS. 5C, and 5F-5H, may trigger the same additional gaming functionality. For example, each of the triggers generally illustrated in FIGS. 5C & 5F-5H may each trigger the additional gaming functionality as generally illustrated in FIG. 5J. In another example, some different predetermined subset of symbol positions, as generally illustrated in FIGS. 5C, and 5F-5H, may trigger different additional gaming functionality. For example, the trigger generally illustrated in FIG. 5C may trigger the additional gaming functionality as generally illustrated in FIG. 5J, while the trigger generally illustrated in FIG. 5F may trigger the additional gaming functionality as generally illustrated in FIG. 5K.

FIG. 5J illustrates one example of the added functionality which may be provided by the present disclosure. In one example, secondary game reels 562 may have stopped and may display various "BONUS" secondary game symbols 530. In one embodiment, secondary game reels 562 may only have "BONUS" symbols associated with them, which again, may make the added functionality more easily understood by a player of the gaming system. First display image 500 now may include a secondary paytable 532 in order to convey to the player both what they have won, and what they could have won, which helps create interest in continuing to play on the gaming system. In the present illustration, the number of "BONUS" secondary game symbols 530 may be accumulated to determine a bonus pay to be provided to the player. Here, the player accumulated five "BONUS" symbols 530, and according to secondary paytable 532, has won the $5^{th}$ PRIZE. It is contemplated that bonus prizes may be monetary, physical, predetermined, randomly determined, progressives, non-cashable credits, free spins of the same and/or different gaming system, multipliers, entry ticket to another game, and/or any combination thereof.

FIGS. 5K and 5L illustrate an alternative embodiment, where secondary game symbols 530 displayed by the secondary game reels may be evaluated in a different manner. As shown in FIG. 5K, the "BONUS" secondary game symbols occurring at secondary symbol positions 540-548 are not added together to determine an award, but rather secondary game paylines (e.g., a first payline 534, a second payline 536, etc.) may be evaluated to determine one or more awards. In the present example, two secondary paylines (e.g., 534 and 536) may indicate winning outcomes. First display image 500 may be caused to display a secondary game paytable 538, which indicates that 2 winning paylines causes the $4^{th}$ prize to be awarded to the player.

FIG. 5L illustrates eighteen possible secondary game payline configurations that may be utilized in the evaluation illustrated in FIG. 5K. It is readily apparent that if a standard left-to-right evaluation is utilized for the 3×3 secondary game matrix of the present embodiment, twenty-seven (e.g., 3×3×3=27) possible paylines exist. And if vertical paylines, right-to-left paylines, or paylines that utilize more or less than three positions are utilized, the number of possible paylines can significantly increase. FIGS. 5J and 5K illustrate examples where the secondary reels utilize the same number of symbol positions as the predetermined subset of symbol positions they may be replacing, which in this case may be nine symbol positions. It is contemplated that the secondary game reels may utilize fewer symbol positions and/or a greater number of symbol positions as the subset of symbol positions they may be replacing.

FIG. 5M illustrates one example of the added functionality which may be provided by the present disclosure. In one example, secondary game reels 562 may have stopped and are displaying various secondary game symbols (e.g., 541-549). In one example, first display 500 may display one or more secondary game paylines 536 in association with displayed secondary game reels 562. First display image 500 may include a secondary paytable 538A in order to convey to the player both what they have won, and what they could have won, which helps create interest in continuing to play on the gaming system. In the present illustration, secondary game symbols (e.g., 541-549) may be evaluated against a secondary game paytable 538A to see if the player is provided an award. Here, the gaming system displays a "heart" symbol 543, a "triple-7" symbol 545, and a "heart" symbol 547 in association with at least one secondary game payline 536, and according to secondary paytable 538A, has won the $2^{nd}$ PRIZE. It is contemplated that bonus prizes may be monetary, physical, predetermined, randomly determined, progressives, non-cashable credits, free spins of the same or different gaming system, multipliers, entry ticket to another game, and/or any combination thereof. In this example, a seven symbol 541, "triple-7" symbol 545, and a trophy symbol 549 may not have created a winning combination.

FIG. 5N illustrates one example of the added functionality which may be provided by the present disclosure. In one example, secondary game reels 562 may have stopped and are displaying various secondary game symbols (e.g., 541-549). In one example, first display 500 may display one or more secondary game paylines (e.g., 534 & 536) in association with displayed secondary game reels 562. First display image 500 may include a secondary paytable 538A in order to convey to the player both what they have won, and what they could have won, which helps create interest in continuing to play on the gaming system. In the present illustration, secondary game symbols (e.g., 541-549) may be evaluated against a secondary game paytable 538A to see if the player is provided an award. Here, the gaming system displays a "heart" symbol 543, a "triple-7" symbol 545, and a "heart" symbol 547 in association with at least one secondary game payline 536, and also displays a "trophy" symbol 541, the "triple-7" symbol 545, and a "trophy" symbol 549 in association with at least one secondary game payline 534, and according to secondary paytable 538A, has won the $2^{nd}$ PRIZE and the $3^{rd}$ PRIZE. It is contemplated that bonus prizes may be monetary, physical, predetermined, randomly determined, progressives, non-cashable credits, free spins of the same or different gaming system, multipliers, entry ticket to another game, and/or any combination thereof.

In further embodiments, the secondary game displayed by the secondary reels may be varied. In various embodiments, the secondary game may be similar to keno, poker, bingo, roulette, craps, blackjack, slots, based on a random determination, based on at least partially the skill of the player, predetermined, single player, multi-player, and/or any combination thereof.

Figure 6A:
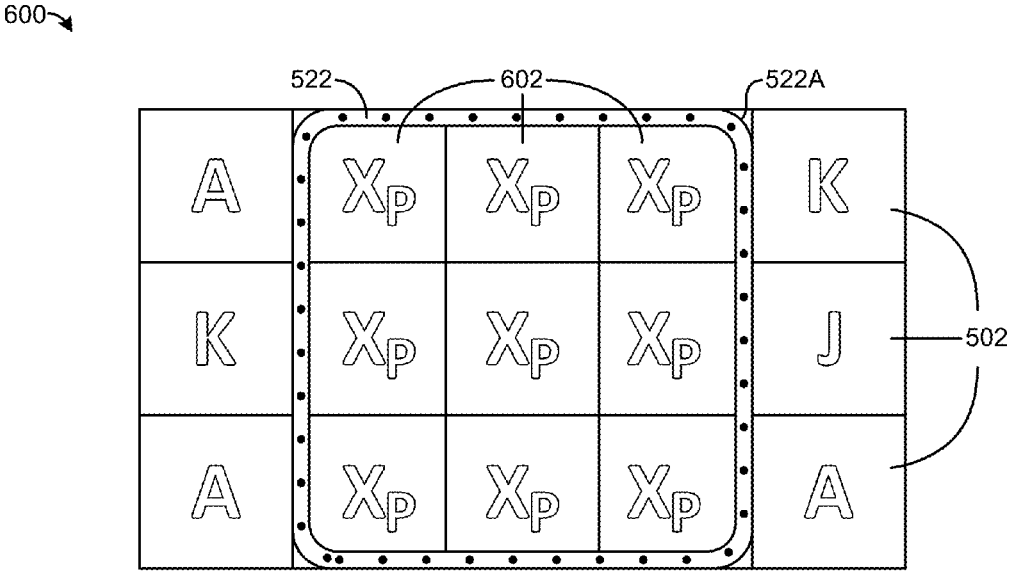
FIG. 6A is an illustration of a display device output on an exemplary gaming system, according to one embodiment.

FIG. 6A illustrates a separate embodiment, and begins with a second display image 600 having matrix 502. In this example, the occurrence of matching symbol "Xp" on qualifying reels 602 triggers the additional gaming functionality. In this example, event notification 522 may be again utilized to inform the player both that they qualified for the additional gaming functionality, and/or how they qualified by highlighting the matching symbols which may be the only symbols displayed by qualifying reels 602.

Figure 6B:
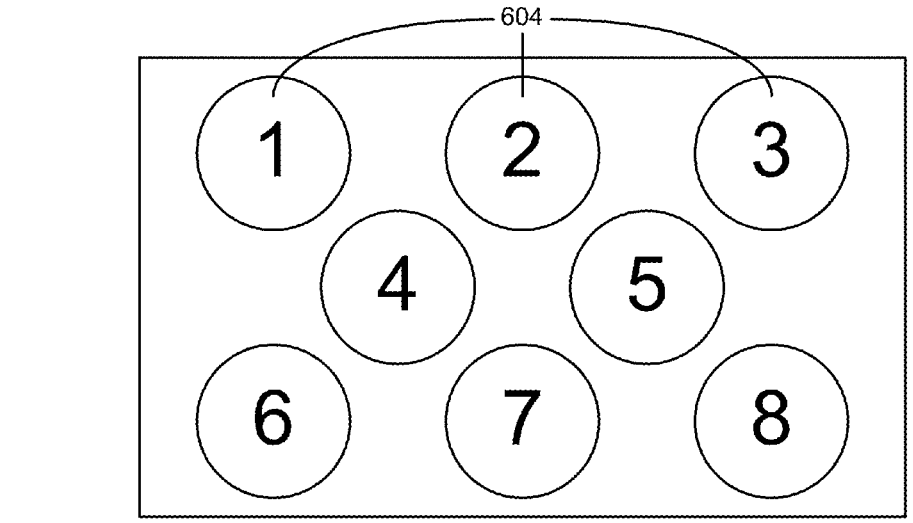
FIG. 6B is another illustration of a display device output on an exemplary gaming system, according to one embodiment.

In FIG. 6B, second display image 600 may have been replaced by a third display image 615, which may display one or more selections 604. In the present embodiment, it is contemplated that the player of the gaming system may be then prompted to select one or more of one or more selections 604. In one embodiment, the number of one or more selections 604 may be dependent upon the wager. In one example, if a player wagered one credit per payline in a play of the primary game, the player may be provided one selection from selections 604, but if the player had wagered three credits per payline in the play of the primary game, the player may have been provided three selections from selections 604. In one embodiment, the number of selections a player may be allowed to make may be randomly determined. In one example, the gaming system may make a random selection of a number from the range of N to Y (e.g., one to seven), and may allow the player to make the number of chosen selections from selections 604. In further embodiments, the number of sections the player is allowed to make may be predetermined, may be greater than the number of triggering matching symbols, may be based on which matching symbol triggered the extra functionality, and/or any combination thereof.

In a different embodiment, each of the matching symbols which trigger the extra functionality may be individually converted into one of the one or more selections 604. An example of this embodiment would be that since nine matching "Xp" symbols triggered the extra functionality, there would be nine selections displayed by third display screen 615, instead of the eight selections currently illustrated in FIG. 6B. In another example of this embodiment, the nine selections would be located at the same relative symbol position of the nine matching "Xp" symbols. In such examples, it may be positively viewed by the player that their reward for achieving such a high number of matching symbols may be an equally high number of selections to choose from.

Figure 6C:
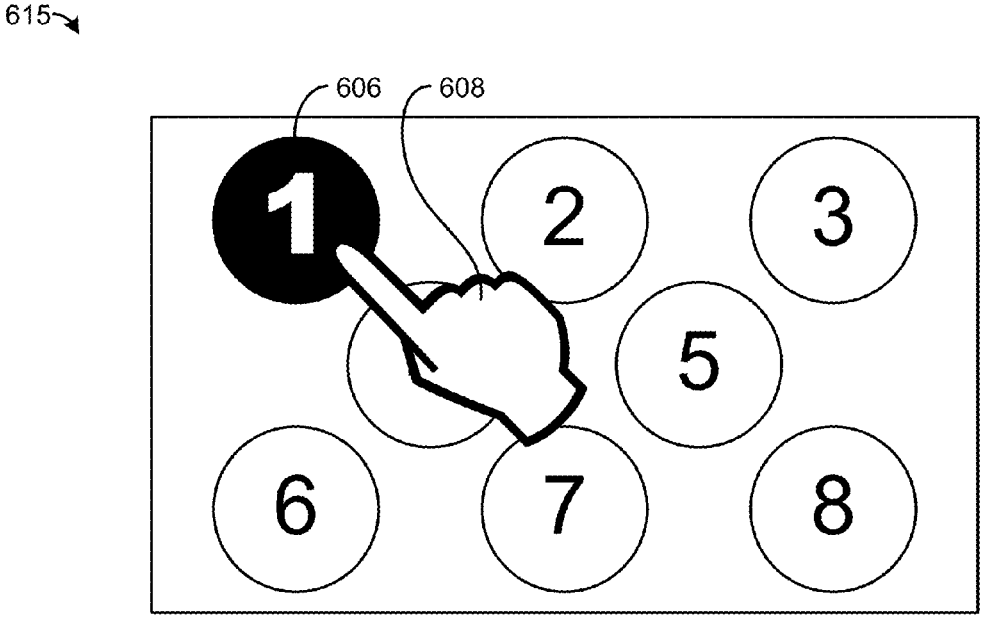
FIG. 6C is another illustration of a display device output on an exemplary gaming system, according to one embodiment.

In FIG. 6C, the player, as represented by hand 608, chooses the first selection 606. It is contemplated that the player may be free to choose any of the displayed selections. In one embodiment, the player may be allowed to only select from less than all of the displayed selections. In one example, the player may have to choose from selections in a first row of selections before selecting from any other selections. In another example, the play may have to select a special symbol in order to qualify to select from another group of selections. In another embodiment, the player does not know what outcome may be associated with any of the selections. In another embodiment, the player may be able to see what outcome may be associated with one or more of the selections.

Figure 6D:
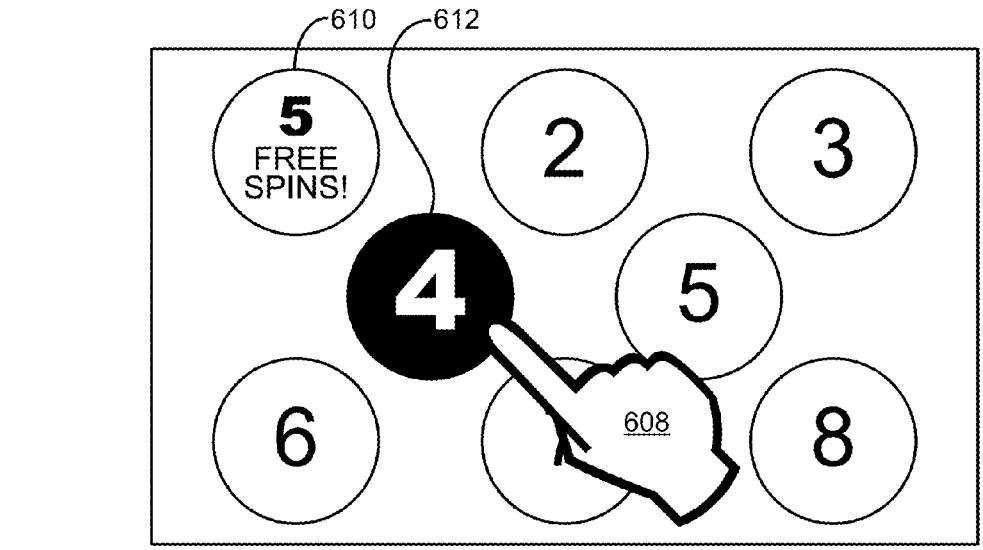
FIG. 6D is another illustration of a display device output on an exemplary gaming system, according to one embodiment.

In FIG. 6D, a first selection chosen by the player may cause a first award 610 to be revealed, which provides the player with 5 free spins. The player, again as represented by hand 608, may choose a fourth selection 612. In one embodiment, the player may utilize a touchscreen input device associated with the gaming system in order to make selections. In another embodiment, the player utilizes a button input device to make selections. In further embodiments, the player utilizes a mouse, touchpad, trackball, keyboard, gestures, voice commands, optical recognition, and/or any combination thereof to make selections.

Figure 6E:
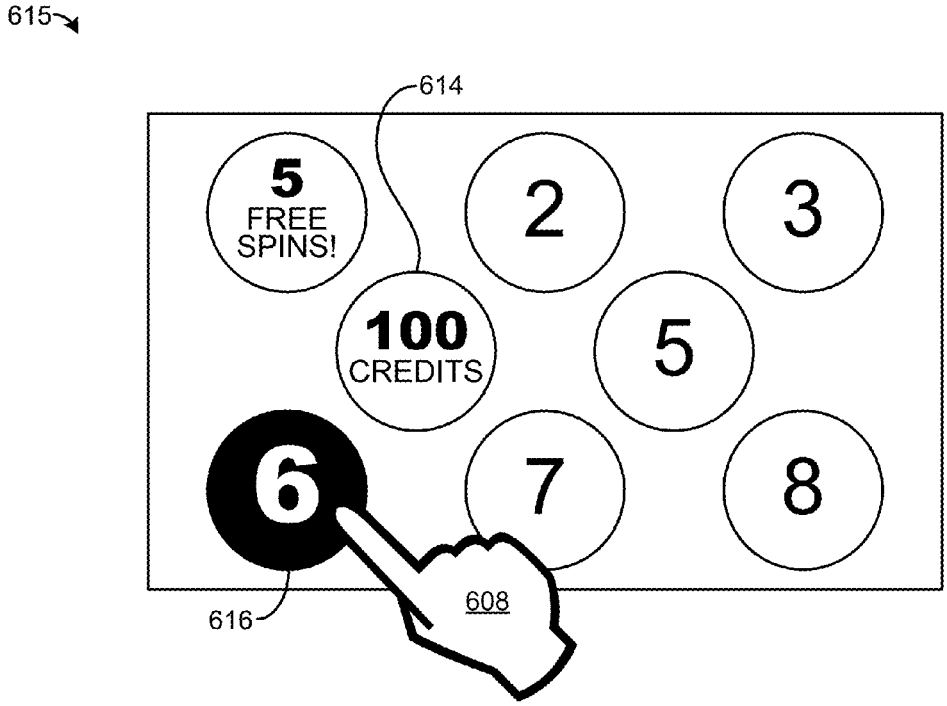
FIG. 6E is another illustration of a display device output on an exemplary gaming system, according to one embodiment.

In FIG. 6E, the fourth selection 614 chosen by the player may reveal a second award 614, which provides the player with 100 credits. The player via hand 608 may then proceed to choose a sixth selection 616.

Figure 6F:
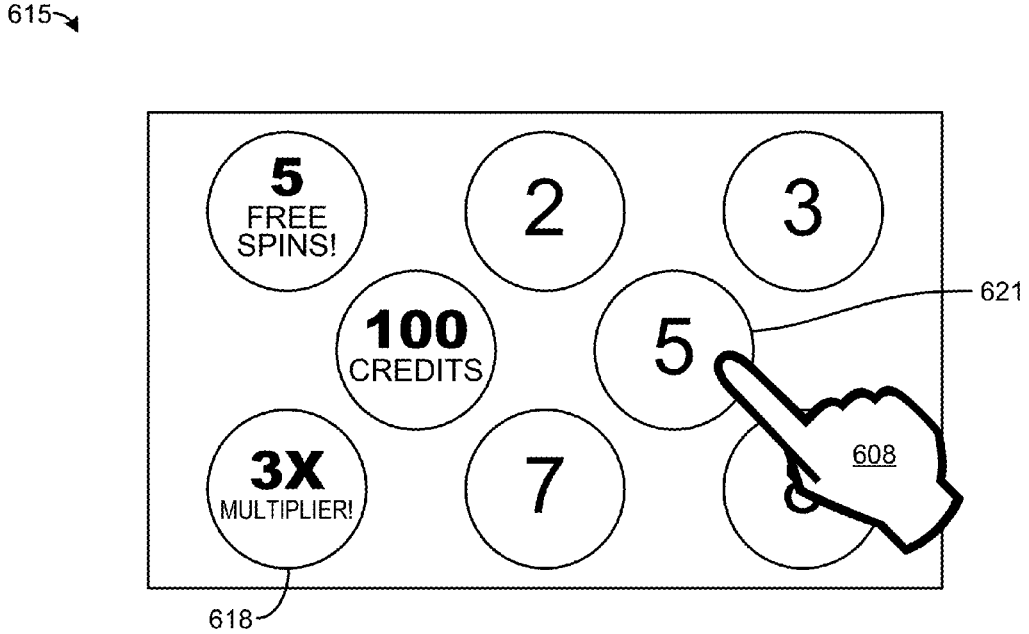
FIG. 6F is another illustration of a display device output on an exemplary gaming system, according to one embodiment.

In FIG. 6F, sixth selection 616 chosen by the player may reveal a third award 618, which may provide the player with a 3× multiplier. In one embodiment, the 3× multiplier may be applied to all awards provided by the secondary game. In another embodiment, the 3× multiplier may be only applied to the previously revealed awards. In the present example, the 3× multiplier would modify the previous award of 100 credits to make it now an award of 300 credits, and would also multiply any awards provided by the 5 free spins. The player via hand 608 may then proceed to choose a fifth selection 621.

Figure 6G:
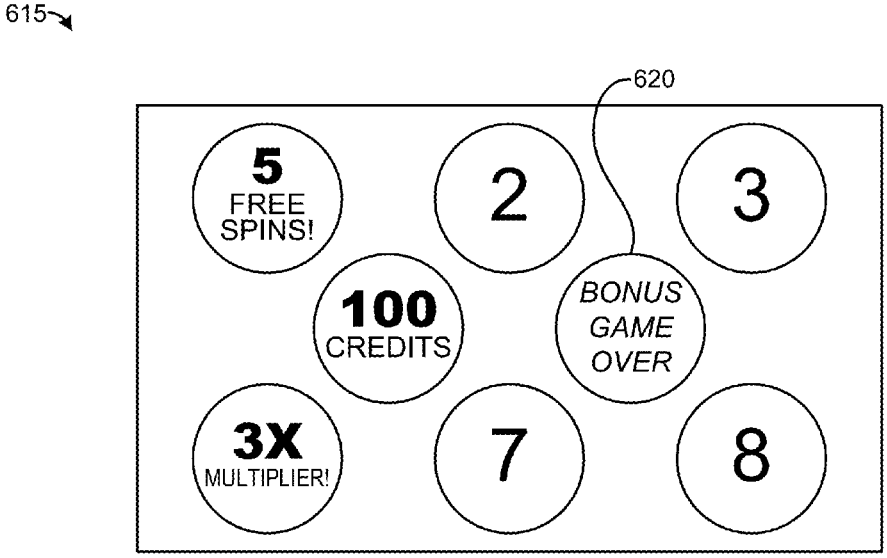
FIG. 6G is another illustration of a display device output on an exemplary gaming system, according to one embodiment.

In FIG. 6G, fifth selection 621 chosen by the player may reveal a game terminator 620, which may end the secondary game. In one embodiment, the player may be allowed to keep all awards previously awarded in the secondary game, and game terminator 620 merely acts to end the game. In another embodiment, the player has the ability to take any awards earned or risk all or part of them in order to make an additional selection, in which case game terminator 620 would act to take back such previously earned awards placed at risk. In one example, these lost awards may go into a bank to potentially be won at a later time.

Figure 6H:
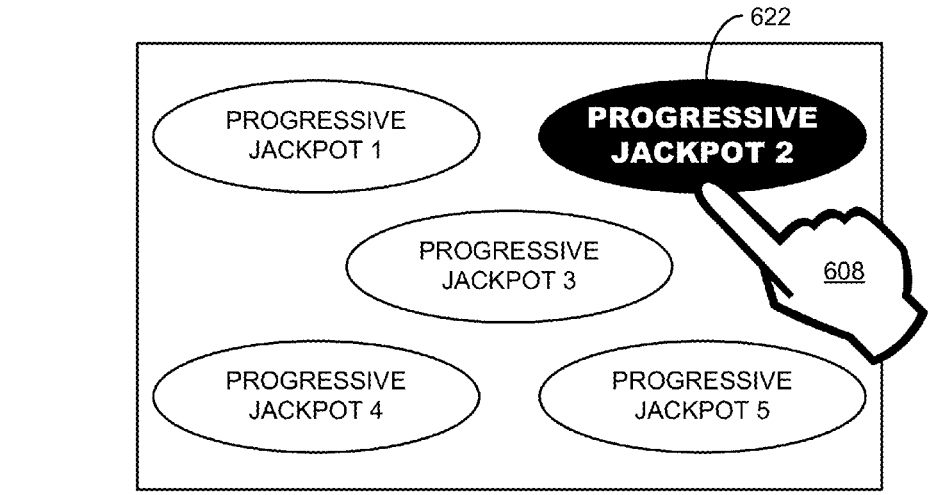
FIG. 6H is another illustration of a display device output on an exemplary gaming system, according to one embodiment.
Figure 6J:
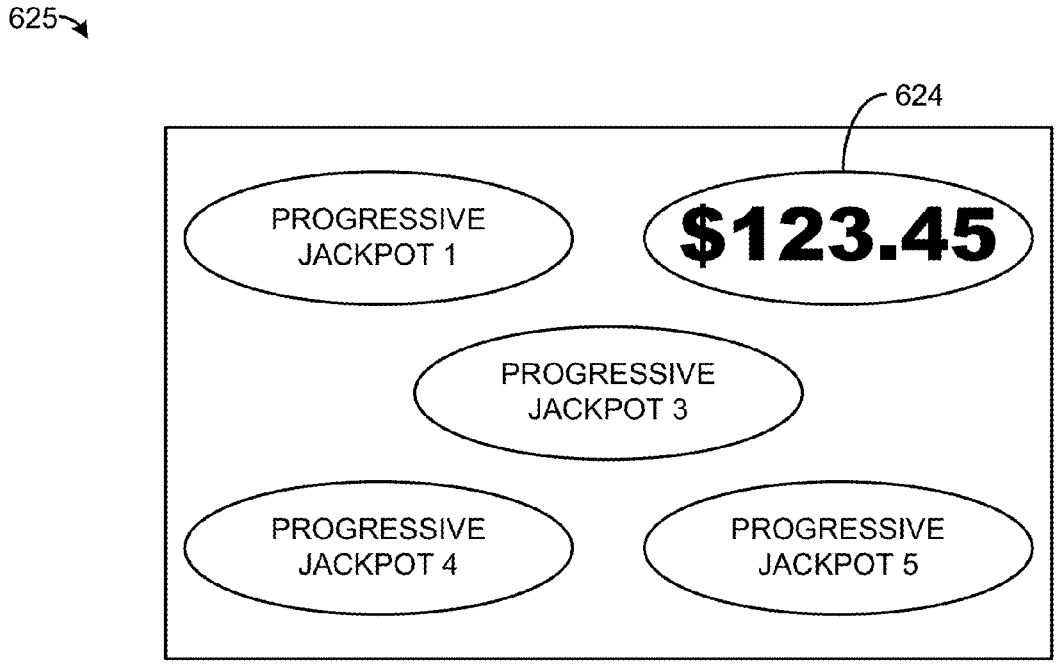
FIG. 6J is another illustration of a display device output on an exemplary gaming system, according to one embodiment.

FIGS. 6H and 6J illustrate a variation of the prior selection secondary game. In this example, the player may be allowed to make a single selection. As illustrated in FIG. 6H, a fourth display image 625 may display five separate selections from which the player makes a choice. It is contemplated that while FIG. 6H illustrates the award associated with each selection, that in one embodiment, the player may not be made aware of which awards may be associated with each selection. In this example, the player via hand 608 chooses Progressive Jackpot 2 selection 622, which may be revealed in FIG. 6J as progressive award 624, which is $123.45. In the present embodiment, the secondary game may be a Multi-Level Progressive ("MLP"), which provides the player an opportunity to win one or more progressive awards.

Figure 7:
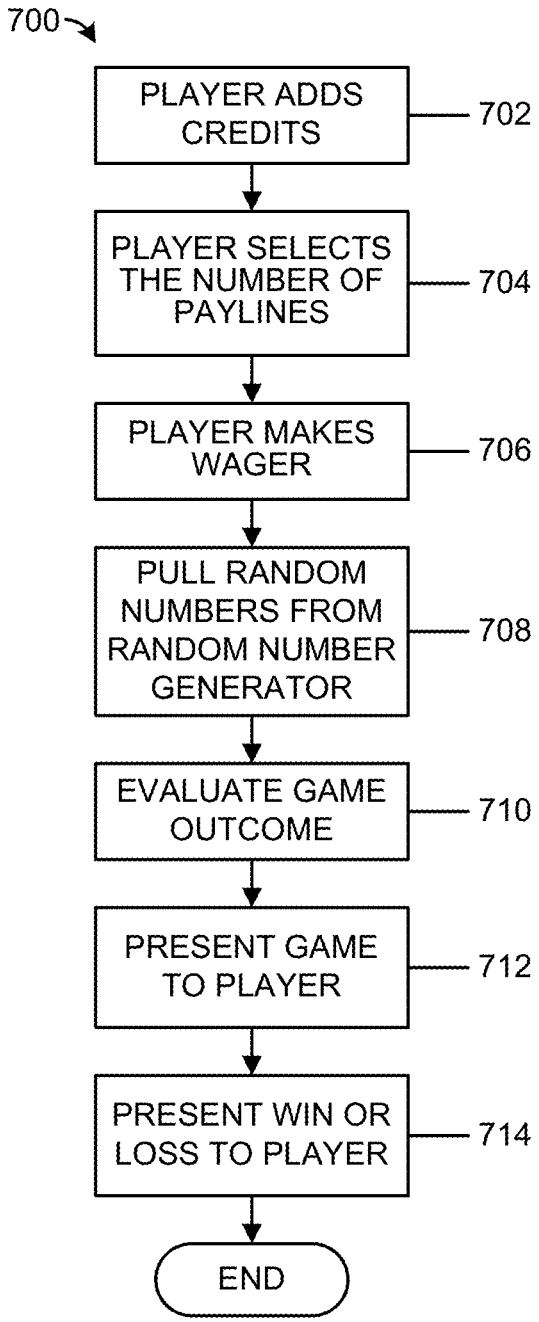
FIG. 7 is a flow diagram for game play, according to one embodiment.

FIG. 7 is a process flowchart of one example of a primary game play 700 on an electronic gaming system, according to one embodiment. The method may include the step of a player adding credit to the electronic gaming system (step 702). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 704, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 706, the player makes a wager on the game. In one embodiment, the wager may be a multiple of the number of paylines selected at step 704. In another embodiment, the wager may not be a multiple of the number of paylines selected at step 704. In a further embodiment, the wager may include a side-wager (e.g., ante bet), which may, in one example of such an embodiment, be used to make the player eligible to be awarded the extra functionality discussed above. It should be appreciated that in some embodiments, the order of steps 704 and 706 may be not critical, and so for example, a player can select the wager they wish to place, and then select the number of paylines they want it applied to, and that these embodiments are expressly contemplated as being within the scope of the present disclosure.

Continuing to step 708, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 710 and 712, the gaming system utilizes the random numbers pulled at step 708 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 714, the win or loss outcome may be identified for the player. In one embodiment, this step can include additional messaging, which provides information related to the win or loss, such as why the player won or lost. In another embodiment, this step can include identification of the amount of any award earned by the player.

Figure 8:
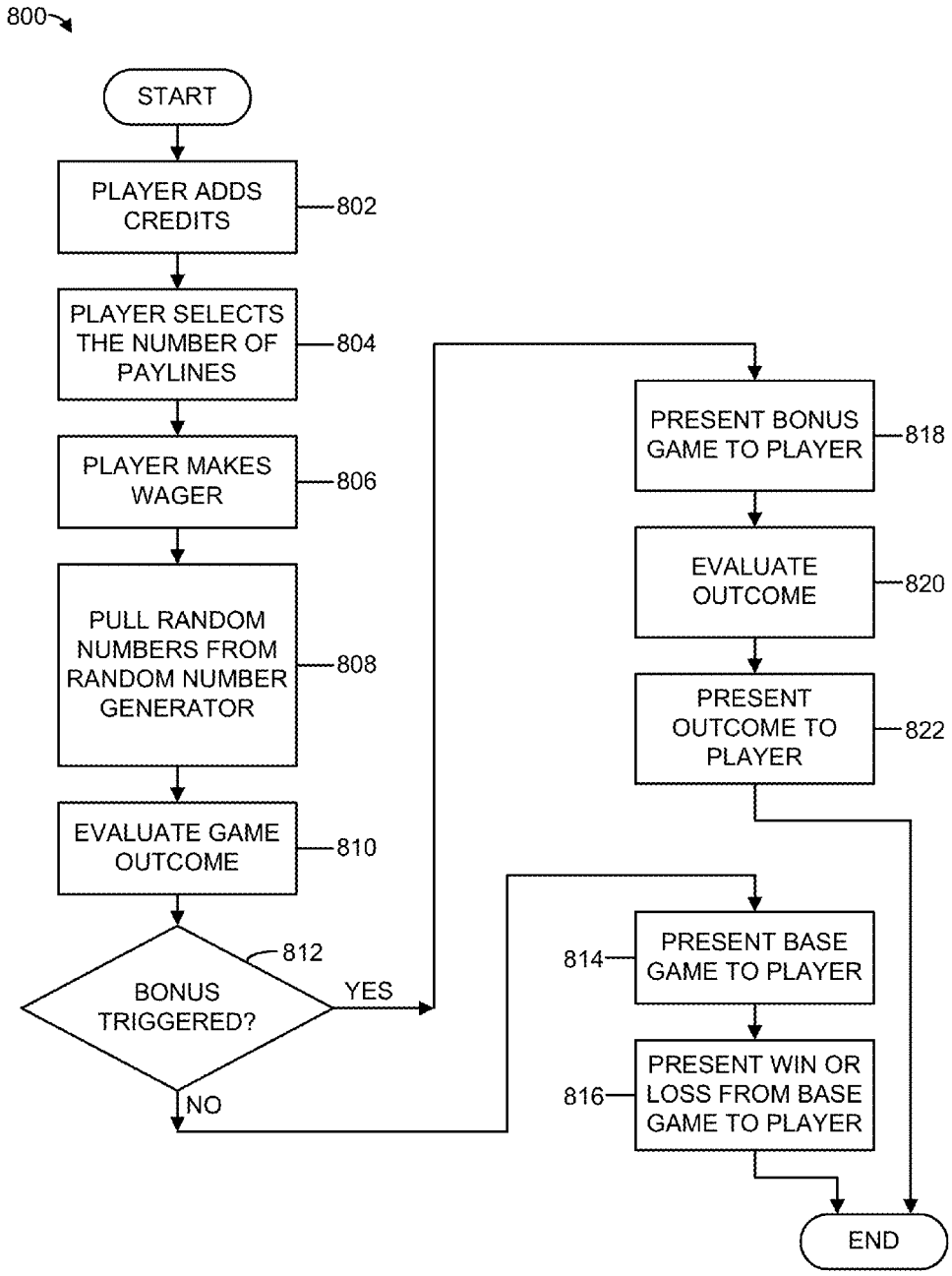
FIG. 8 is another flow diagram for game play, according to one embodiment.

FIG. 8 is a process flowchart of one example of a combined primary and secondary game play 800 on an electronic gaming system, according to one embodiment. The method may include the step of a player adding credit to the electronic gaming system (step 802). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 804, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 806, the player makes a wager on the game. In one embodiment, the wager may be a multiple of the number of paylines selected at step 804. In another embodiment, the wager may not be a multiple of the number of paylines selected at step 804. In a further embodiment, the wager may include a side-wager, which may, in one example of such an embodiment, be used to make the player eligible to be awarded the extra functionality discussed above. It should be appreciated that in some embodiments, the order of steps 804 and 806 may be not critical, and so for example, a player can select the wager they wish to place, and then select the number of paylines they want it applied to, and that these embodiments may be expressly contemplated as being within the scope of the present disclosure.

Continuing to step 808, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 810, the gaming system utilizes the random numbers pulled at step 808 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 812, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols are displayed on the $2^{nd}$,$3^{rd}$ and $4^{th}$ reel, as generally illustrated in FIG. 5B. In another example, the bonus game may be triggered if matching symbols are displayed on the $1^{st}$, $2^{nd}$ and $3^{rd}$ reels, as generally illustrated in FIG. 5F. In a further example, the bonus game may be triggered if matching symbols occur at predetermined symbol positions that include consecutive and non-consecutive reels, as generally illustrated in FIG. 5H.

If it is determined that a bonus or secondary game was not triggered, the process continues to step 814, where the base game may be fully presented to the player. As discussed above, the orders of step 810, 812, and 814 can be changed without affecting the novel concepts disclosed herein.

At step 816, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 812 that a bonus or secondary game was triggered, then process 800 continues to step 818, where the secondary game may be presented to the player. As discussed above, there are numerous ways to present the secondary or bonus game to the player.

At steps 820 and 822, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 800 ending after step 822, the process continues to step 814 so as to finalize the primary game outcome presentation to the player.

Figure 9:
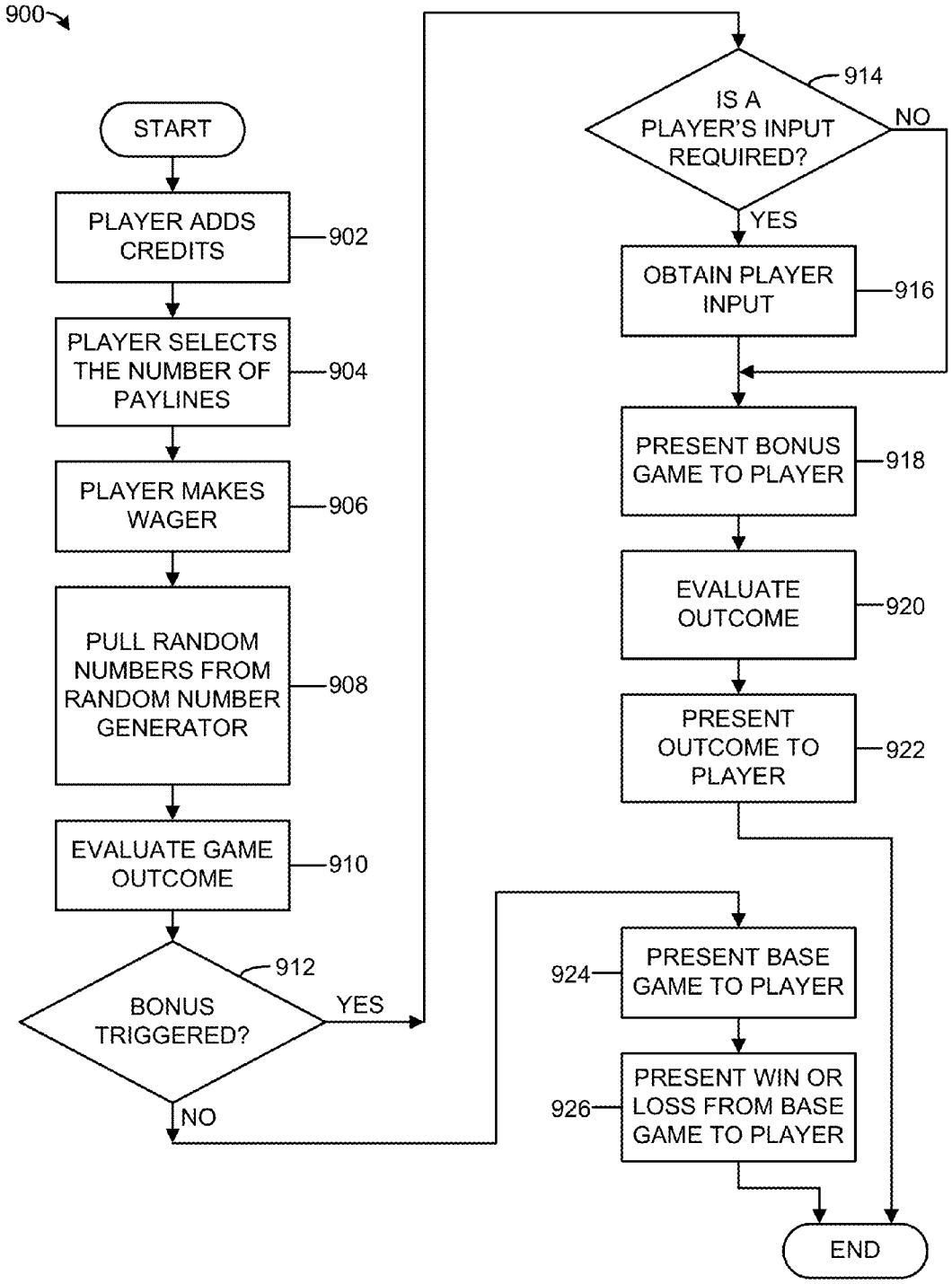
FIG. 9 is another flow diagram for game play, according to one embodiment.

FIG. 9 is a process flowchart of one example of a combined primary and secondary game play 900 on an electronic gaming system, according to one embodiment. The method may include the step of a player adding credit to the electronic gaming system 902. It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 904, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 906, the player makes a wager on the game. In one embodiment, the wager may be a multiple of the number of paylines selected at step 804. In another embodiment, the wager may not be a multiple of the number of paylines selected at step 904. In a further embodiment, the wager may include a side-wager, which may, in one example of such an embodiment, be used to make the player eligible to be awarded the extra functionality discussed above. It should be appreciated that in some embodiments, the order of steps 804 and 806 may not be critical, and so for example, a player can select the wager they wish to place, and then select the number of paylines they want it applied to, and that these embodiments are expressly contemplated as being within the scope of the present disclosure.

Continuing to step 908, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 910, the gaming system utilizes the random numbers pulled at step 908 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 912, the gaming system determines if a secondary or bonus game may be triggered. In one embodiment, the bonus game may be triggered by the display of a plurality of matching symbols at a plurality of predetermined symbol positions within a play of the primary game. In one example, the bonus game may be triggered if a plurality of matching symbols are displayed on the $2^{nd}$,$3^{rd}$ and $4^{th}$ reel, as generally illustrated in FIG. 5B. In another example, the bonus game may be triggered if matching symbols are displayed on the $1^{st}$,$2^{nd}$ and $3^{rd}$ reels, as generally illustrated in FIG. 5F. In a further example, the bonus game may be triggered if matching symbols occur at predetermined symbol positions that include consecutive and non-consecutive reels, as generally illustrated in FIG. 5H.

If it is determined that a bonus or secondary game was not triggered, the process continues to step 924, where the base game is fully presented to the player. As discussed above, the orders of step 910, 912, and 924 can be changed without affecting the novel concepts disclosed herein.

At step 926, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 912 that a bonus or secondary game was triggered, then process 900 continues to step 914, where the gaming system determines if player input is required to play the secondary game. If player input is required, the process continues to step 916, where player input may be obtained via at least one player input device. In one embodiment, the player utilizes a touchscreen input device associated with the gaming system in order to make selections. In another embodiment, the player utilizes a button input device to make selections. In further embodiments, the player utilizes a mouse, touchpad, trackball, keyboard, gestures, voice commands, optical recognition, and/or any combination thereof to make selections.

Once player input is obtained, or if no player input is required, process 900 continues to step 918, where the bonus game may be presented to the player. In one example, this step may include the presentation of selections for the player. At steps 920 and 922, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, steps 918-922 cause the need for additional player input, so they may need to loop back to step 914 in order to receive such additional player input. In one embodiment, instead of the process 900 ending after step 922, the process continues to step 924 so as to finalize the primary game outcome presentation to the player.

Figure 10:
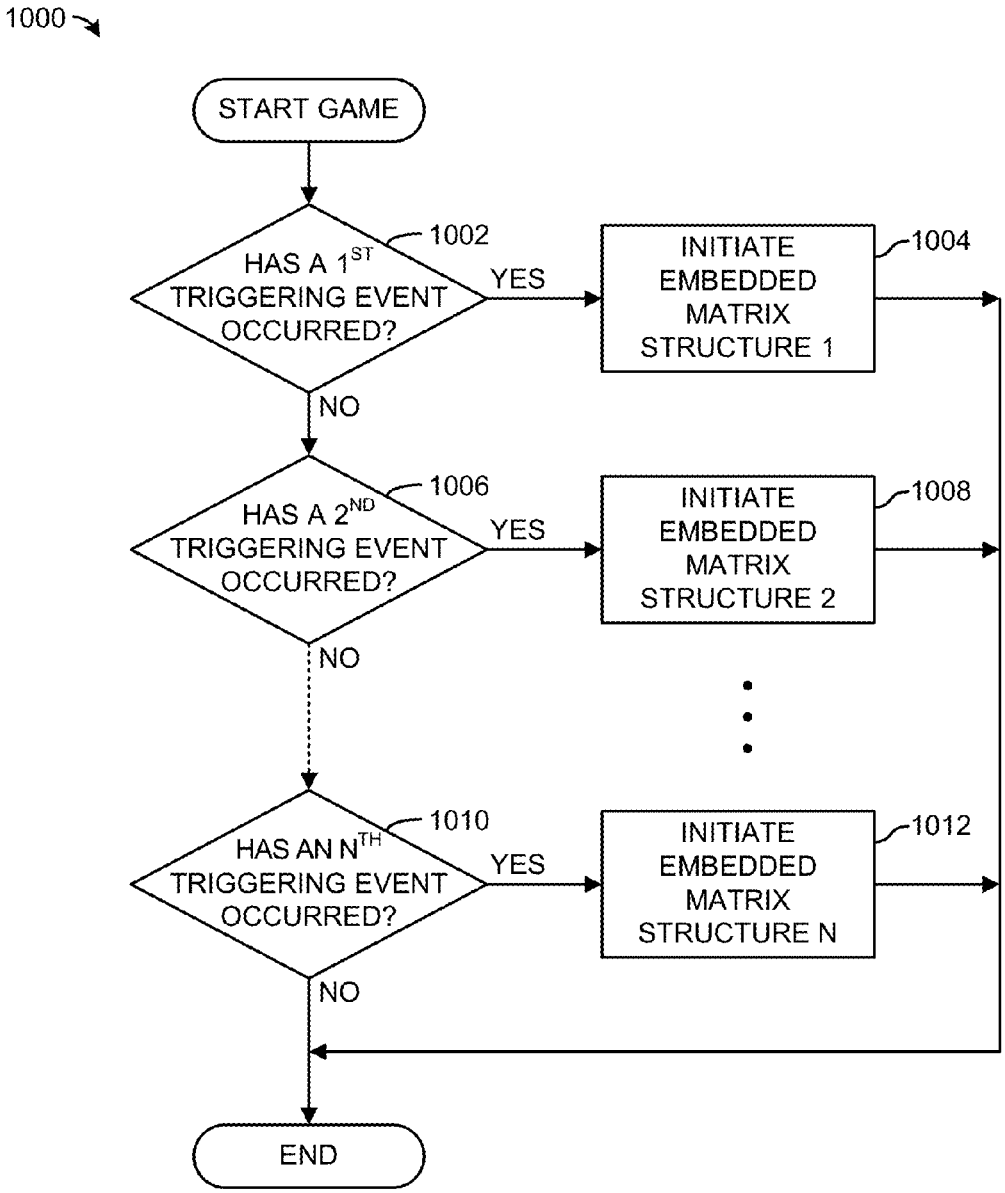
FIG. 10 is another flow diagram for game play, according to one embodiment.

In FIG. 10, a game play flow chart 1000 is shown, according to one embodiment. The method may include the game starting. The method may include electronic gaming device 100 and/or electronic gaming system 200 determining whether a first triggering event has occurred (step 1002). If a first triggering event has occurred, then the method may initiate an embedded matrix 1 (step 1004). If the first triggering event has not occurred, then the method may move to step 1006. The method may include electronic gaming device 100 and/or electronic gaming system 200 determining whether a second triggering event has occurred (step 1006). If a second triggering event has occurred, then the method may initiate an embedded matrix 2 (step 1008). If the second triggering event has not occurred, then the method may move to step 1010. The method may include electronic gaming device 100 and/or electronic gaming system 200 determining whether an Nth triggering event has occurred (step 1010). If the Nth triggering event has occurred, then the method may initiate an embedded matrix N (step 1012). If the Nth triggering event has not occurred, then the method may end.

In another embodiment, once the first embedded matrix structure is initiated (step 1004), then the method may move to step 1006 and/or step 1010. In another embodiment, once the second embedded matrix structure is initiated (step 1006), then the method may move to step 1002 and/or step 1010. It should be noted that any variations of these steps is within the scope of this disclosure.

In various embodiments, first embedded matrix structure, second embedded matrix structure, third embedded matrix structure, . . . . Nth embedded matrix structure are different structures. These different structures may have completely different symbol structures, common symbol structures (e.g., similar symbols but not identical symbols, some common symbols and some different symbols, etc.) and/or identical symbol structures.

Figure 11:
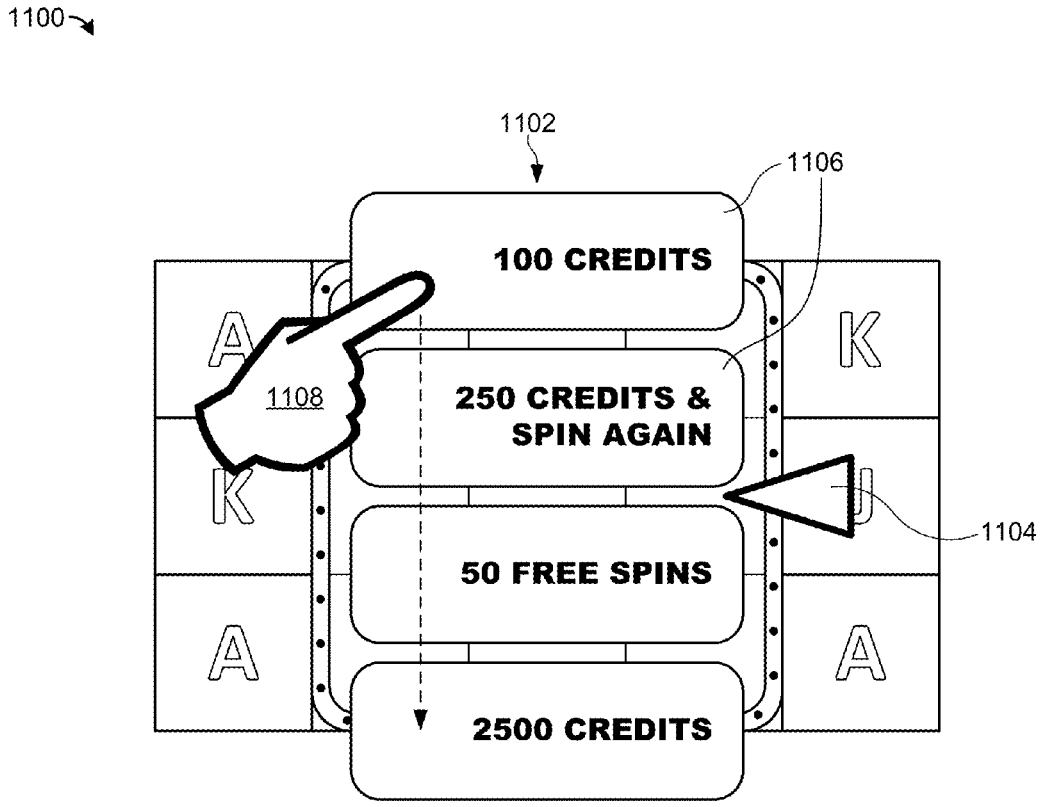
FIG. 11 is another illustration of a display device output on an exemplary gaming system, according to one embodiment.

FIG. 11 is another illustration of a display device output on an exemplary gaming system, according to one embodiment. Wheel image 1100 may include a wheel 1102, a pointer 1104, one or more values 1106, and a hand 1108. In this example, embedded matrix was replaced by wheel 1102. The player via hand 1108 (and/or any other input device) may spin wheel 1102. A player may win an award based on one or more values 1106 being indicated by pointer 1104.

In another example, the funding for the bonus may be based on an ante bet. In one example, a player may place an ante bet on one or more of the paylines utilized in the embedded matrix. The size of the prize may be based on the bet level, according to one embodiment.

In one embodiment, the gaming system may include one or more display devices. In another embodiment, the gaming system may include one or more input devices. In a further embodiment, the gaming system may include one or more memory devices. In another embodiment, the gaming system may include one or more processors. In a further embodiment, the gaming system may include instructions on the processor which causes the processor to operate with at least one display device and at least one input device to determine a wager place by a player of the electronic gaming system, determine a plurality of primary game symbols to display in a plurality of symbol positions for a play of the primary game, cause the at least one display device to display the determined primary game symbols in the plurality of symbol positions, and/or determine if a secondary game is triggered. When the secondary game is triggered the at least one display device may display a plurality of matching primary game symbols in each of a predetermined plurality of vertically-adjacent symbol positions and/or a predetermined plurality of horizontally-adjacent symbol positions. The one or more processors may upon a determination that the secondary game is triggered, determine a plurality of secondary game symbols to display, cause the at least one display device to replace each of the matching primary game symbols determined to have triggered the secondary game with the determined plurality of secondary game symbols, determine a secondary game outcome based at least in part on the displayed plurality of secondary game symbols, and/or cause the gaming system to provide any awards determined to be awarded.

The matching symbols may be visually identical symbols. The number of determined secondary game symbols may equal the number of primary game symbols. Each of the secondary game symbols may be displayed at each of the primary game symbol positions determined to have triggered the secondary game. Each of the vertically-adjacent matching primary game symbols may be displayed as part of a single reel. The gaming system may cause an event notification to be displayed on the at least one display device. The at least one memory device may be a server memory.

In one embodiment, a method of providing gaming options via an electronic gaming system is utilized. This method may include determining a wager player by a player of the gaming system. This method may include determining a plurality of primary game symbols to display in a plurality of symbol positions for a play of a primary game. This method may cause at least one display device to display the determined primary game symbols in the plurality of symbol positions. This method may include determining if a secondary game is triggered. This method may include, upon determining that a secondary game is triggered, determining a plurality of secondary game symbols to display, and/or may further cause a plurality of matching primary game symbols to be replaced by the determined secondary game symbols. This method may include determining a secondary game outcome based at least in part on the displayed plurality of secondary game symbols. This method may include causing the gaming system to provide any awards determined to be awarded.

In one embodiment, the electronic gaming system may include at least one display device, at least one input device, at least one memory device, and/or at least one processor. In one embodiment, the at least one processor may receive instructions from the at least one memory device, and to operate with the at least one display device and the at least one input device to display a plurality of reels associated with a plurality of primary game symbols, to display the reels spinning, to display the reels stopping, and/or to determine if a secondary game is triggered. In one embodiment, if the secondary game is triggered, the gaming system may replace at least two adjacent reels with an equal number of secondary game reels, display the spinning of the secondary game reels, display the secondary game reels stopping, and/or providing any awards determined to be awarded.

In one example, the system and/or method may determine that a key value (e.g., winning amount) is 10,000 credits. The key value may be the amount of credits (and/or multipliers and/or free spins and/or any other item of value) won. In this example, the 10,000 credit key value number may be utilized to determine one or more presentations associated with this 10,000 credits key value number. There may be presentation indexes numbered 0 to N associated with the 10,000 credits key value number.

The system and/or method may select (e.g., randomly, by a predetermined pattern, shuffle, combination thereof, and/or any other selection method) one or more of the presentations based on the key value.

In one example, the method may include determining a winning credit amount. The method may include looking up one or more presentations related to the winning credit amount. The method may include modifying the set of presentations relating to the winning credit amount based on one or more criteria. The method may include selecting a presentation from the modified set of presentations based on one or more criteria. The method may include displaying the selected presentation. The method may end.

For example, the presentation may be modified to include an advertisement, a movie trailer, a movie promotion, a casino event, a casino promotion, an actor's image, the player's image, etc.

In one embodiment, the electronic gaming device may include a plurality of reels, one or more paylines formed on at least a portion of the plurality of reels, a memory, and a processor. The memory may include a presentation module. The presentation module may include a plurality of presentations. The processor may determine a value. The processor may select one or more presentations based on the value.

In another example, the processor may randomly select the one or more presentations related to the value. In an example, the processor may select the one or more presentations related to the value in a predetermined pattern.

In another example, the value may be based on an input from a player. In an example, the processor may display a presentation based on one or more presentations. In another example, the processor may display a themed presentation based on one or more criteria. In an example, the themed presentation may be based on an advertisement and/or any other theme.

In another embodiment, the method of providing gaming options via an electronic gaming device may include receiving one or more primary wagers on one or more paylines, starting a bonus game, determining one or more values, and/or selecting one or more presentations based on the one or more values.

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on one or more paylines. The processor may receive one or more secondary wagers on one or more selected paylines (e.g., repeat paylines, patterns, scenarios, etc.). The selected paylines may be based on data received from a player. The processor may determine a selected payline's payout based on the one or more selected paylines (e.g., repeat paylines, patterns, scenarios, etc.).

In another example, the display may shade one or more non-selected paylines. The electronic gaming device may include a player preference input device. The player preference input device may modify a game configuration based on data from an identification device. The processor may multiply a prize value based on a selected payline occurrence.

In another example, the method may include obtaining a player preference data and modifying a game configuration based on the player preference data. The method may include receiving data from at least one of a server and one or more gaming devices.

In another example, the processor may determine a payout based on the primary wagers. The processor may receive one or more secondary wagers on one or more patterns. The electronic gaming device may include a display, which may display a game status image.

In another embodiment, the electronic gaming system may include a server. The server may include a server memory, a server processor, and a signage server. The server memory may include historical gaming data. The server processor may generate a gaming message based on the historical gaming data. The signage server may transmit the gaming message.

In another example, the gaming message may be transmitted to an internal display of a gaming entity. The internal display may be a non-gaming device display. The gaming message may be transmitted to an external display of a gaming entity. The external display may be located outside of a gaming entity. The gaming message may be transmitted to at least one of a top display, a main display, and a side display.

The plurality of reels may form a 5-by-5 matrix, a 3-by-5 matrix, a 4-by-matrix, a 4-by-3 matrix, a 5-by-3 matrix, or any number-by-any number matrix. The symbols may be an image of a card, an image, and/or other objects. For example, it could be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

The disclosed features may be part of the base game and/or a bonus game. In addition, the disclosed features may be part of a base bet and/or may require an additional side bet (e.g., ante bet).

In one embodiment, the electronic gaming device may include a plurality of reels. One or more paylines may be formed on at least a portion of the plurality of reels. The electronic gaming device may include a memory. The memory may include one or more embedded game play structures. The electronic gaming device may include a processor. The processor may initiate the one or more embedded game play structures based on one or more triggering events.

In another example, the one or more initiated embedded game play structures are further based on one or more characteristics of the one or more triggering events. In one example, the processor may display a first game event. In another example, the first game event may include one or more first game event options. In another example, the processor may receive one or more selections relating to the one or more first game event options.

In one example, the processor may display a second game event based on the one or more selections relating to the one or more first game event options. The second game event may include one or more second game event options. The processor may receive one or more selections relating to the one or more second game event options. The processor may display a third game event based on the one or more selections relating to the one or more second game event options.

In one embodiment, the method of providing gaming options via an electronic gaming device may include receiving one or more wagers on one or more paylines. The method may include determining one or more triggering events. The method may include displaying one or more embedded game play structures.

In one example, the method may include initiating one or more embedded game structures based on one or more characteristics of the one or more triggering events. In another example, the method may include displaying a first game event. In one example, the first game event may include one or more first game event options.

In another example, the method may include receiving one or more selections relating to the one or more first game event options. The method may include displaying a second game event based on the one or more selections relating to the one or more first game event options. The method may include that the second game event includes one or more second game event options.

In another example, the method may include receiving one or more selections relating to the one or more second game event options. The method may include displaying a third game event based on the one or more selections relating to the one or more second game event options.

In another embodiment, the electronic gaming system may include a server. The server may include a server memory and a server processor. The server memory may include one or more embedded game play structures. The server processor may initiate the one or more embedded game play structures based on a triggering event. In one example, the server processor may display a first game event.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system may be powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system may be different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," "may," "another example," and/or similar language, should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming system comprising:

at least one electronic video display device;

at least one input device;

at least one memory device;

at least one wager accepting device configured to accept a physical item associated with a monetary value to increase a credit balance on the electronic gaming system; and at least one processor configured to receive a plurality of instructions from the at least one memory device, which when executed by the at least one processor, cause the at least one processor to:

(a) determine a wager from the credit balance placed by a player of the electronic gaming system;

(b) cause the at least one electronic video display device to display primary game symbols in association with primary symbol positions defined by a plurality of primary reels;

(c) determine if a secondary game is triggered, wherein the secondary game is triggered when the at least one display device displays a plurality of matching primary game symbols;

(d) upon determining that the secondary game is triggered:

(1) cause the at least one electronic video display device to display one or more secondary reels in place of a subset of said primary symbol positions, said secondary reels displaying a plurality of secondary game symbols;

(2) determine a secondary game outcome based solely upon said displayed secondary game symbols; and (e) award at least one secondary game award for one or more winning secondary game outcomes.

2. The electronic gaming system of claim 1 wherein the number of secondary reels is greater or less than the number of primary reels corresponding to said subset of primary symbol positions.

3. The electronic gaming system of claim 1 wherein said plurality of secondary game symbols is greater or lesser in number than the number of primary game symbols in said subset of primary symbol positions.

4. The electronic gaming system of claim 1 wherein said at least one processor causes a periphery of an area of said plurality of primary reels containing said at least one subset or primary symbol positions to be highlighted if the secondary game is triggered.

5. The electronic gaming system of claim 1 wherein said secondary game is triggered when the at least one display device display a plurality of matching primary game symbols in a first subset of primary symbol positions and said secondary reels are displayed in place of a second subset of primary symbol positions.

6. The electronic gaming system of claim 1 wherein said secondary reels display a plurality of secondary symbol positions and secondary game symbols are displayed in at least some of said secondary symbol positions.

7. The electronic gaming system of claim 1 wherein said at least one processor awards at least one primary game award based upon a winning combination of primary game symbols.

8. A method of presenting a wagering game via an electronic gaming system comprising:

(a) receiving a physical item associated with a monetary value at a wager accepting device of the electronic gaming system, a credit balance at the electronic gaming system being increased by the monetary value, and determining a wager from the credit balance placed by a player of the electronic gaming system;

(b) causing at least one electronic video display device to display primary game symbols in association with primary symbol positions defined by a plurality of primary reels;

(c) determining if a secondary game is triggered, wherein the secondary game is triggered when the at least one display device displays a plurality of matching primary game symbols;

(d) upon determining that the secondary game is triggered:

(1) causing the at least one electronic video display device to display one or more secondary reels in place of a subset of said primary symbol positions, said secondary reels displaying a plurality of secondary game symbols;

(2) determining a secondary game outcome based solely upon said displayed secondary game symbols; and (e) awarding at least one award for one or more winning secondary game outcomes.

9. The method of claim 8 wherein the number of secondary reels is greater or less than the number of primary reels corresponding to said subset of primary symbol positions.

10. The method of claim 8 wherein said plurality of secondary game symbols is greater or lesser in number than the number of primary game symbols in said subset of primary symbol positions.

11. The method of claim 8 further comprising highlighting a periphery of an area of said plurality of primary reels containing said at least one subset or primary symbol positions if the secondary game is triggered.

12. The method of claim 8 wherein said secondary game is triggered when the at least one display device display a plurality of matching primary game symbols in a first subset of primary symbol positions and said secondary reels are displayed in place of a second subset of primary symbol positions.

13. The method of claim 8 wherein said secondary reels display a plurality of secondary symbol positions and secondary game symbols are displayed in at least some of said secondary symbol positions.

14. The method of claim 8 wherein said subset of primary symbol positions comprises primary symbol positions associated with at least M primary reels and said step of causing the at least one electronic video display to display one or more secondary reels comprises displaying N secondary reels, wherein N is greater than M.

15. The method of claim 8 wherein said step of causing the at least one electronic video display device to display one or more secondary reels in place of a subset of said primary symbol positions comprises displaying said one or more secondary reels in an area of said primary reels corresponding to said subset of primary symbol positions.

16. The method of claim 8 comprising displaying said one or more secondary reels in a spinning condition while said primary game reels are fixed.

17. The method of claim 8 further comprising awarding at least one primary game award for one or more winning combinations of said primary game symbols.

* * * * *